US008469001B2

(12) United States Patent
Yoshizaki et al.

(10) Patent No.: US 8,469,001 B2
(45) Date of Patent: Jun. 25, 2013

(54) WORK APPARATUS WITH INTERNAL COMBUSTION ENGINE

(75) Inventors: Takuo Yoshizaki, Kokubunji (JP); Kazuhiro Yoneyama, Tokyo (JP); Masao Iwata, Yokosuka (JP); Naoto Kawahara, Yokohama (JP)

(73) Assignee: Yamabiko Corporation, Tokyo (JP)

( * ) Notice: Subject to any disclaimer, the term of this patent is extended or adjusted under 35 U.S.C. 154(b) by 552 days.

(21) Appl. No.: 12/622,874

(22) Filed: Nov. 20, 2009

(65) Prior Publication Data

US 2010/0147544 A1 Jun. 17, 2010

(30) Foreign Application Priority Data

Nov. 20, 2008 (JP) ..... 2008-296249

(51) Int. Cl.
*F02P 5/145* (2006.01)
*F02D 41/22* (2006.01)

(52) U.S. Cl.
USPC ..... 123/406.13; 123/198 DC; 123/406.53; 123/406.59; 123/359

(58) Field of Classification Search
USPC ..... 123/198 DC, 406.13, 406.53, 406.59, 123/338, 359; 30/381
See application file for complete search history.

(56) References Cited

U.S. PATENT DOCUMENTS

| | | | | |
|---|---|---|---|---|
| 3,664,390 | A * | 5/1972 | Mattsson et al. | 30/381 |
| 4,079,708 | A | 3/1978 | Wieland et al. | |
| 4,336,778 | A * | 6/1982 | Howard | 123/334 |
| 4,543,723 | A * | 10/1985 | Bortfeld et al. | 30/381 |
| 4,553,517 | A * | 11/1985 | Andreasson | 123/329 |
| 4,753,012 | A * | 6/1988 | Schurr | 30/382 |
| 5,050,553 | A * | 9/1991 | Erhard | 123/406.54 |
| 5,445,121 | A * | 8/1995 | Kai | 123/198 DC |
| 7,040,282 | B2 * | 5/2006 | Andersson et al. | 123/335 |
| 7,171,942 | B2 * | 2/2007 | Nickel | 123/335 |
| 7,699,039 | B2 | 4/2010 | Carlsson et al. | |
| 2010/0323592 | A1 * | 12/2010 | Nemetz et al. | 451/353 |

FOREIGN PATENT DOCUMENTS

| | | |
|---|---|---|
| JP | 11-229966 | 0/1999 |
| JP | 51-111999 | 2/1976 |
| JP | 2006-118499 JP | 5/2006 |
| JP | 2009-511801 | 3/2009 |
| WO | WO 2007/043930 A1 | 4/2007 |

* cited by examiner

*Primary Examiner* — Erick Solis
(74) *Attorney, Agent, or Firm* — Kilyk & Bowersox, P.L.L.C.

(57) ABSTRACT

Problems:
For enhanced safety of a work apparatus with an internal combustion engine, a cutting element is prevented from an accidental run due to an accidental increase of the engine revolution while a throttle control trigger is in a released state.
Solution:
In an engine start period, a throttle valve (10) is in a first idling position. The engine 2 at its initial run phase does not increase in revolution because of instability of its running condition. When the running condition begins to stabilize, the revolution rapidly increases. When the engine revolution (Ne) reaches 4,000 rpm or higher, a non-firing control mode is set up. In the non-firing control mode, when the engine revolution reaches or exceeds 4,500 rpm, a non-firing processing is executed (S4). A centrifugal clutch (6) is designed to engage at 5,000 rpm.

10 Claims, 19 Drawing Sheets

FLOW FOR CANCELING NON-FIRING CONTROL MODE

FLOW FOR CANCELING NON-FIRING CONTROL MODE

FLOW FOR CANCELING NON-FIRING CONTROL MODE

WORK APPARATUS WITH INTERNAL COMBUSTION ENGINE

FIELD OF THE INVENTION

The present invention relates to a work apparatus such as a chain saw, brush cutter, or the like, for driving a cutting element with an internal combustion engine.

BACKGROUND OF THE INVENTION

Chain saws and brush cutters are known as portable work apparatuses for logging or trimming trees, or mowing grass. Some of compact work apparatuses of this type use electric motors as their drive sources. Most of them, however, are equipped with internal combustion engines (that are typically single-cylinder two-stroke engines or single-cylinder four-stroke engines), and are generally configured to transmit the engine power to the cutting element via a centrifugal clutch (Patent Document 1).

In addition, work apparatuses of this type generally use a carburetor (Patent Documents 2 to 4). Patent Documents 2 to 4 disclose technologies related to starting an engine in a cold state or in a hot state. More specifically, Patent Document 2 discloses a mechanical linkage between a throttle control trigger to be operated by an operator for control the engine output combined with a selector (substantial choke knob) and a throttle valve combined with a manual choke valve. Patent Document 3 discloses a mechanical linkage between a throttle valve and a manual choke valve. Similarly, Patent Document 4 discloses a mechanical linkage between a throttle valve and a manual choke valve.

A procedure for starting an engine in a cold state is explained below.

(1) A choke knob is operated to set the choke valve at a full-shut position. Responsively, a throttle valve is positioned and held at a "first idling position".

(2) In case the engine has a recoil starter as its trigger device, a starter grip of the recoil starter is pulled several times to feed a cylinder with fuel-rich air-fuel mixture, and the pulling operation is repeated until explosion occurs in the cylinder. In general, the air-fuel mixture fed by this operation is too rich to continue the explosion. Therefore, the engine does not continue to rotate, and stops after several cycles of explosion.

(3) The choke knob is next operated to return the choke valve at its full-open position. The throttle valve is maintained at the "first idling position". Under the condition, the starter grip of the recoil starter is pulled again. Thus, the engine gets in continuous rotation.

(4) When a throttle control trigger is operated, linkage between the throttle valve and the choke valve is cut off, and the throttle valve takes a position of an opening degree in accordance with the operation of the throttle control trigger. In other words, the throttle control trigger and the throttle valve are mechanically linked, which results in producing an engine output corresponding to the operation of the throttle control trigger. Then, the throttle control trigger is released, and the throttle valve is accordingly brought to and held at a "normal idling position" that is a nearly full-shut position. Therefore, operation of the throttle control trigger after starting the engine can be regarded as an operation for cutting the linkage between the throttle valve and the choke valve.

PRIOR ART DOCUMENTS

Patent Documents

[Patent Document 1] JP 2006-118499 A

[Patent Document 2] JP 51-111999 A

[Patent Document 3] JP 11-229966

[Patent Document 4] JP 2009-511801

Problems to be Solved by the Invention

It is already known that, in order to enhance the start reliability of an engine, the throttle valve had better be open by a certain degree when the engine is activated. The aforementioned "first idling position" is determined from this viewpoint. More specifically, an opening degree corresponding to, for example, 7,000 rpm is preset as the throttle opening degree for the "first idling position".

On the other hand, a "normal idling position" is preset at a throttle opening degree that narrows the effective intake cross-sectional area to a level where the engine can maintain its rotation, i.e. a level where the engine does not interrupt its rotation. This "normal idling position" is preset at a throttle opening degree where an engine revolution of, for example, 2,500 rpm to 3,500 rpm can be maintained (nearly full-shut position).

Since the throttle valve is set at the first idling position upon activating the engine, the engine revolution may rise to about 7,000 rpm. Once the engine revolution rises to this level, the centrifugal clutch undesirably engages. Therefore, instruction manuals of such work apparatuses give a cautionary notation that instructs users to do a braking operation (ON operation of a brake lever) to forcibly prohibiting accidental rotation of the cutting element when he/she activates the engine. Centrifugal clutches, in general, are designed to engage at 5,000 rpm approximately.

As far as a user takes a procedure for starting the engine after operating the brake lever ON in accordance with the instructions of the manual, the cutting element will not move even if the engine revolution rises along with activation of the engine because the cutting element is braked. In this status, however, the friction elements of the centrifugal clutch are in frictional movement. Therefore, if this status continues for a long time, the centrifugal clutch becomes hot, and the friction elements wear out. On the other hand, if the user inadvertently activates the engine, failing to operate the brake lever ON, the clutch engages when the engine stabilizes in revolution after activation and reaches a revolution higher than a critical revolution for the clutch engagement. As a result, the cutting element runs accidentally against the operator's intention.

These problems will be overcome by a special control upon activating the engine. Namely, upon activating the engine, the throttle valve is set at a throttle position where the engine can be activated reliably, which is a position where the throttle valve is opened to a certain degree, and, once the engine starts and stabilizes in operation, the throttle opening degree is reduced. It is relatively easy to realize this kind of control of the throttle opening degree upon activating the engine by incorporating an actuator in the throttle valve and electronically controlling the actuator. However, for portable work apparatuses that are demanded to be compact and lightweight, incorporating an actuator in the throttle valve is a solution that is desirably avoided from the viewpoints of an increase of parts and cost.

It is an object of the present invention to provide a work apparatus powered by an internal combustion engine capable of keeping a centrifugal clutch disengaged while assuring the start reliability of the engine in a start period of the engine.

A further object of the invention is to provide a work apparatus powered by an internal combustion engine capable of preventing an accidental run of the cutting element against the user's intention.

A still further object of the present invention is to provide a work apparatus powered by an internal combustion engine capable of preventing wear of a centrifugal clutch.

SUMMARY OF THE INVENTION

The Inventors carefully reviewed changes in running profiles of engines during start periods of engines relative to engine revolutions where centrifugal clutches engage, and thereby worked out the present invention. Running profile of an engine in its start period can be roughly divided into three phases. In a very short duration immediate after the engine begins to run, the running behavior of the engine is still instable, and the average revolution does not rise so much (initial running phase). After that, when the running behavior of the engine begins to stabilize, the engine revolution rises rapidly (transitional phase). Eventually, the engine stably runs at a revolution (for example, about 7,000 rpm) corresponding to a first idling position of the throttle valve (stabilized phase).

Such changes of the running profile of an engine in the initial start phase were reviewed in comparison with the engine revolution at which friction elements of the centrifugal clutch begins to engage. It has been confirmed that, in the initial running phase, the engine revolution does not rise to a value for the centrifugal clutch to engage. Centrifugal clutches get in engagement in the transitional phase in which the engine revolution is rising rapidly.

According to a first aspect of the invention, the above-mentioned objects are accomplished by providing a work apparatus with an internal combustion engine of a portable type, including the internal combustion engine which has a carburetor having a throttle valve to generate power by igniting air-fuel mixture supplied from the carburetor with an ignition device; and a centrifugal clutch interposed between the internal combustion engine and a cutting element to transmit the power of the internal combustion engine to the cutting element via the centrifugal clutch when engaged, comprising:

an engine start detecting means for detecting that said internal combustion engine is in a start period;

a revolution detecting means for detecting revolution of the internal combustion engine; and an ignition control means responsive to a signal from the revolution detecting means in said start period of the engine to execute non-firing processing for said ignition device when said revolution of the internal combustion engine is higher than a first predetermined revolution.

In greater detail of the engine start detecting means, in case the work apparatus is of a type in which the control means operates with power supply from an electric generating mechanism driven by the engine, the fact that the engine is in the start period can be detected indirectly from activation of the control means. In other words, in this case, activation of the control means along with activation of the engine directly indicates that the engine is in the start period. In case the work apparatus has a battery, the fact that the engine has entered in the start motion can be detected from any material, such as an ON signal of an element, like an auxiliary device, which is sensitive to a start motion of the engine, a signal of any kinds of sensors sensitive to the start motion of the engine, an input signal from the engine revolution detecting means, an ON signal of a starter switch if it is an electric starter, a change of pressure in the carburetor, a change of pressure in a pulse path of an insulator, or the like.

Upon activating the engine, an operator may tightly squeeze the throttle control trigger to activate the engine. In most cases, however, the operator operates the choke knob to activate the engine. In response to such operation of the choke knob, the throttle valve is set at the "first idling position" as explained above. The "first idling position" pertains to an opened position of the throttle valve for activating the engine. It is 7,000 to 8,000 rpm in terms of engine revolution in a stabilized running condition of the engine, although it may vary with the engine design. The revolution for the friction elements of the centrifugal clutch to start engaging is usually set at 4,000 to 5,000 rpm.

The predetermined revolution as a threshold for executing the non-firing processing is set, with reference to the revolution where the friction elements of the centrifugal clutch begins to engage, at a revolution near and lower than the revolution for the friction elements of the centrifugal clutch to begin engagement.

According to said first aspect of the invention, in an initial running phase of the engine immediately after activating the engine in which the running condition of the engine is unstable and the engine revolution does not rise so high, the non-firing control is not executed such that the start reliability of the engine can be assured as much as in conventional engines under a throttle opening degree such as the first idling position at which the throttle valve is opened relatively wide.

On the other hand, in the transitional phase of the engine in which the engine begins to stabilize in running condition and rapidly increase the revolution, the non-firing processing added to the ignition control causes almost no unintentional interruption of the engine. Therefore, the upper limit of the engine revolution can be regulated by executing the non-firing processing. As an example of the non-firing processing in addition to the processing of canceling ignition by the ignition device (processing of interrupting power supply to the ignition device), combustion in the cylinder may be substantially invalidated by extremely delaying the ignition timing normally designed at about 30° before the top dead center of the piston stroke (for example, the ignition timing is set such that ignition occurs near the bottom dead center instead).

In relation to the engine revolution in the engine start period, it is the first predetermined engine revolution as a threshold value that substantially determines the upper limit of the engine revolution. As explained above, this first predetermined engine revolution is set at a revolution capable of keeping the centrifugal clutch unengaged. In this manner, even though the engine is activated, subsequently stabilized in running condition, and elevated in revolution, the engine revolution can be limited at a level capable of maintaining the centrifugal clutch disengaged. Of course, keeping the centrifugal clutch disengaged results in maintaining interruption of power transmission from the engine to the cutting element. Therefore, according to the first aspect of the invention, the work apparatus can maintain the centrifugal clutch in a disengaged state while assuring the start reliability of the engine.

In case the work apparatus has both a normal ignition control mode for executing an ordinary igniting operation and a non-firing control mode for executing the non-firing processing, the non-firing processing may be executed in the non-firing control mode when it is determined that the engine revolution rises higher than the clutch-engaging revolution by estimating, in response to a signal from the revolution detecting means, whether or not the engine revolution rises higher than the clutch-engaging revolution at which the centrifugal clutch begins to engage.

This estimation can be reworded substantially as estimation whether the engine is in the transitional phase or not. Therefore, once the engine revolution becomes higher than a second predetermined revolution that is near and lower than the clutch-engaging revolution, the engine condition may be regarded as being in the transitional phase and the non-firing control mode may be started. Alternatively, by monitoring the magnitude of acceleration of the engine revolution, once the acceleration exceeds certain reference acceleration, the engine may be determined to be in the transitional phase, and the non-firing control mode may be started accordingly.

Duration of time required from the initial running phase to the stabilized phase in the engine start period is usually 0.3 to 0.5 seconds. After the time of 0.2 to 0.3 seconds passes from the first explosion, the engine revolution increases by a high acceleration (transitional phase).

Also when an operator tries to activate the engine in a state where the throttle valve is opened by operating the throttle control trigger, the engine revolution may increase to an engine revolution at which the friction elements of the centrifugal clutch begin to engage. Here again, the centrifugal clutch can be maintained disengaged by executing the non-firing processing.

It should be noted that the engaged state of the centrifugal clutch herein pertains to a state where the cutting element continuously runs at a high speed. For understanding the present invention, momentary engagement of the clutch in a state where the cutting element slightly moves and stops is also included the disengaged state or condition of the centrifugal clutch.

When viewed from another aspect, the present invention can be evaluated as a solution to prevent an accidental run of the cutting element of the work apparatus against the users intention.

According to the second aspect of the invention, there is provided a work apparatus with an internal combustion engine of a portable type, including the internal combustion engine which has a carburetor having a throttle valve to generate power by igniting air-fuel mixture supplied from the carburetor with an ignition device; a manual throttle control trigger for controlling the open-close motion of said throttle valve; and a centrifugal clutch interposed between the internal combustion engine and a cutting element to transmit the power of the internal combustion engine to the cutting element via the centrifugal clutch engaged when the engine output is increased by operation of said throttle control trigger, comprising:

an engine revolution detecting means for detecting engine revolution of said internal combustion engine;

an idling position detecting means for detecting whether said throttle valve is in an idling position or not; and an ignition control means for executing non-firing processing for said ignition device when the throttle valve is in said idling position and said engine revolution is higher than a first predetermined revolution.

According to the second aspect of the invention, the non-firing processing is executed when the engine revolution detected is higher than the predetermined value while the throttle valve is in the idling position. The predetermined value as a threshold is set, with reference to the clutch-engaging revolution where the friction elements of the centrifugal clutch begin to engage, at a revolution near and lower than the clutch-engaging revolution for the friction elements of the centrifugal clutch to begin engagement.

The idling position detecting means for detecting whether or not the throttle valve is in the idling position may be a sensor that detects an opened position of the throttle valve. Typically, however, it is a sensor or a switch that detects whether the throttle control trigger is in a released state or not.

According to the second aspect of the invention, even if the engine revolution rises for some kind of reason while throttle control trigger is out of contact of operator's hands during a break, for example, the non-firing control is executed if the engine revolution rises to or beyond the predetermined revolution. Therefore, it is reliably prevented that the friction elements of the centrifugal clutch get in engagement and that the engine revolution rises until bringing the centrifugal clutch into engagement. Accordingly, it is prevented that the cutting element accidentally runs in absence of user's consciousness notwithstanding the throttle control trigger is in a released position. Accidental rapid increase of the engine revolution regardless of the throttle control trigger being in a released position occurs when, for example, the work apparatus is changed in posture, the work apparatus is immediately before running out of fuel in the carburetor, and so forth.

When viewed from still another aspect, the present invention can be evaluated as a solution for preventing the centrifugal clutch from wearing. From this third aspect, the present invention is specified as follows.

That is, according to the third aspect of the invention, there is provided a work apparatus with an internal combustion engine, which is of a portable type, including the internal combustion engine which has a carburetor having a throttle valve to generate power by igniting air-fuel mixture supplied from the carburetor with an ignition device; and a centrifugal clutch interposed between the internal combustion engine and a cutting element to transmit the power of the internal combustion engine to the cutting element via the centrifugal clutch when engaged, comprising:

an engine revolution detecting means for detecting engine revolution of said internal combustion engine;

a braking detecting means for detecting that a brake for braking said cutting element is in a braking state; and an ignition control means for executing non-firing processing for said ignition device when said engine revolution detected is higher than a predetermined revolution while said brake is detected to be in said braking state by said braking detecting means.

The braking detecting means may detect the braking state directly, or may detect it indirectly by detecting the current position of a brake lever. Alternatively, the braking detecting means may detect the braking state indirectly by detecting the temperature of the centrifugal clutch or its periphery element or material.

In the third aspect of the invention as well, the predetermined revolution as the threshold for executing the non-firing processing is set, with reference to the clutch-engaging revolution where friction elements of the centrifugal clutch begin to engage, at a revolution near the clutch-engaging revolution at which the friction elements of the centrifugal clutch begin to engage.

According to the third aspect of the invention, the non-firing control is executed when the engine revolution increases for some kind of reason notwithstanding the brake is in the braking position, and the friction elements of the centrifugal clutch begin to engage and slip. Thereby, the work apparatus can maintain the centrifugal clutch disengaged, or can stop the slip of the centrifugal clutch early. Therefore, the work apparatus can prevent the centrifugal clutch from wear that was inevitable in conventional apparatuses configured to keep the cutting element inoperative relying upon a slipping or frictional force of the centrifugal clutch by braking it.

These and other objects and advantages of the present invention will become apparent from the description of embodiments that will follow.

DETAILED DESCRIPTION OF THE INVENTION

Some preferred embodiments are explained below with reference to the drawings.

Figure 1:
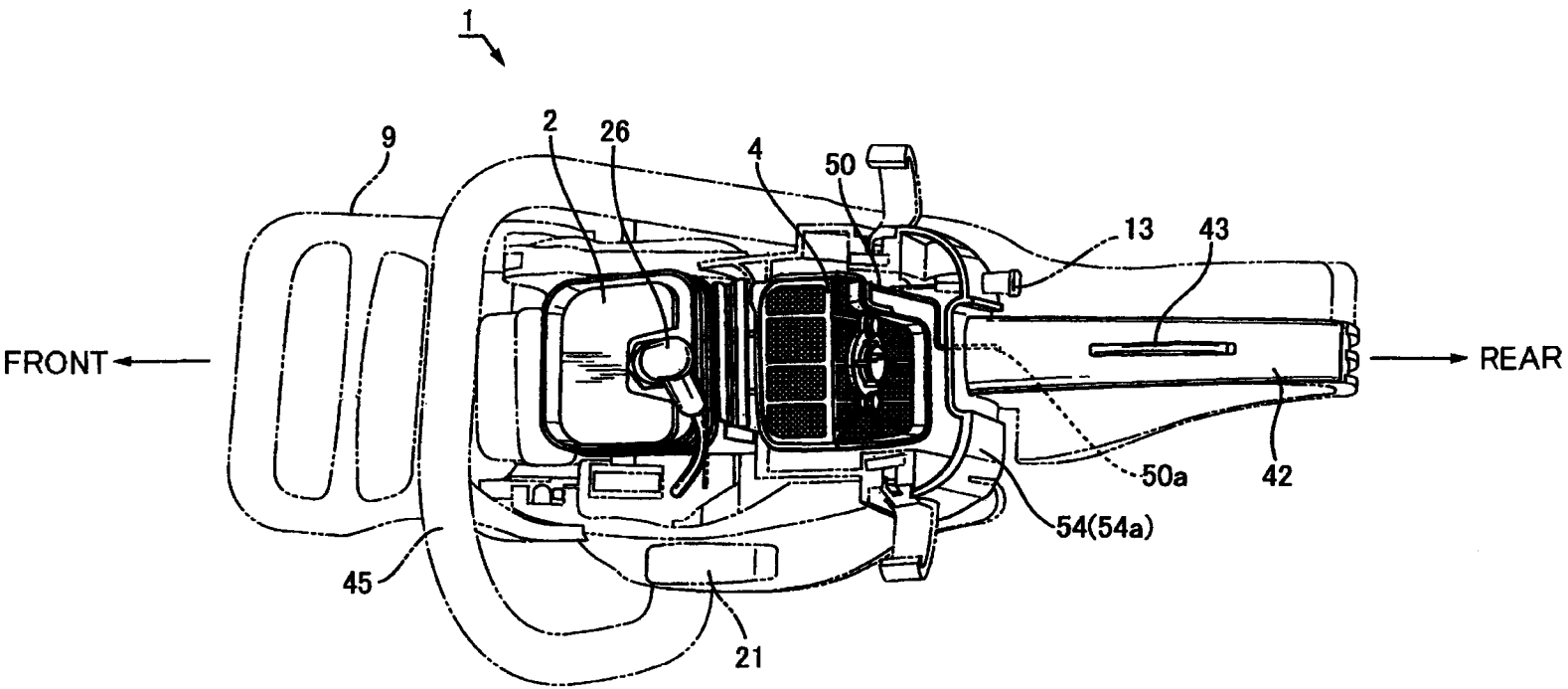
FIG. 1 is a top view of a main body of a chain saw according to an embodiment of the invention, from which a chain bar and a saw chain have been removed.
Figure 2:
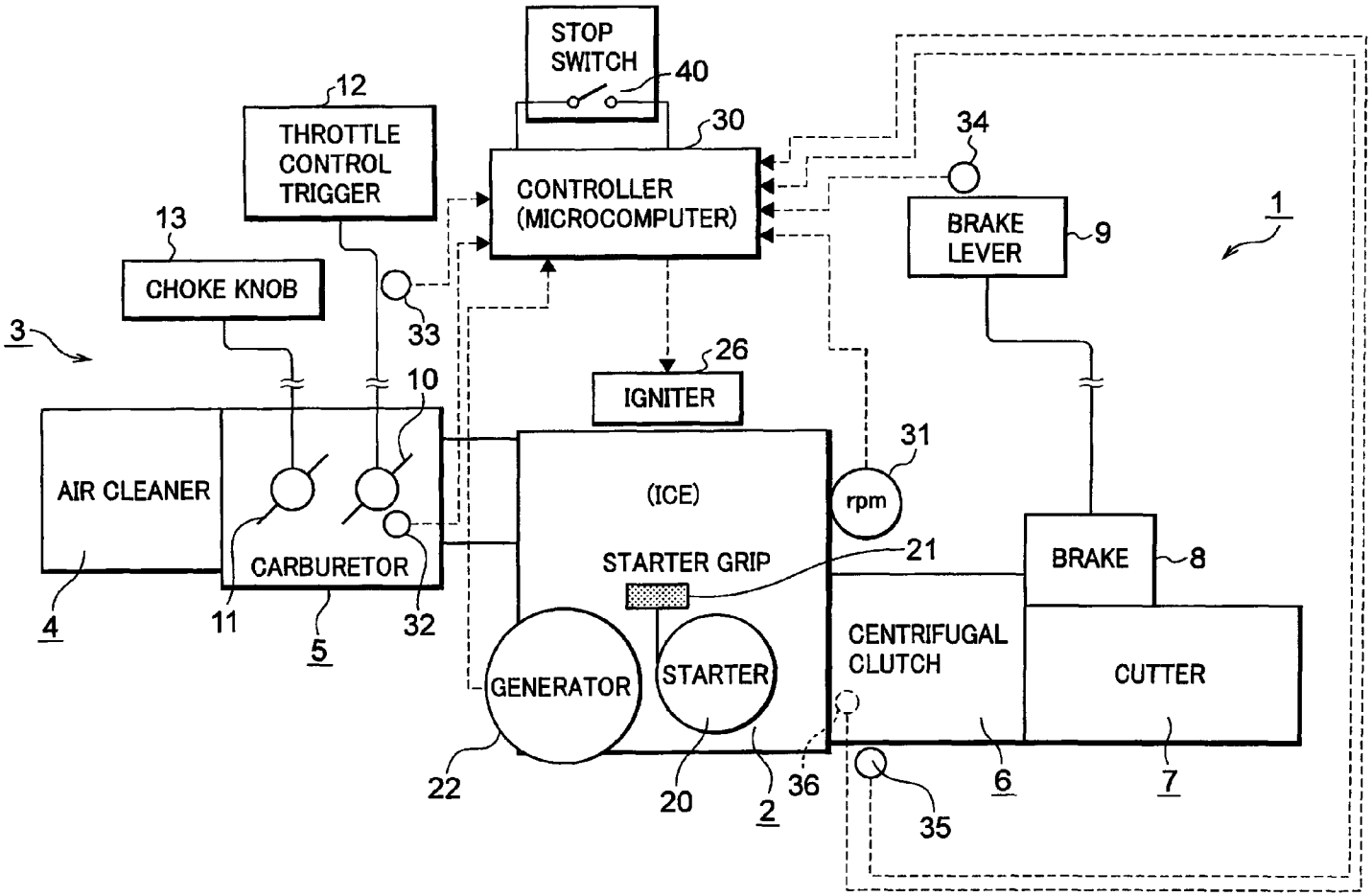
FIG. 2 is a view showing the entire configuration of the chain saw according to the embodiment.

FIG. 1 is a plan view of a chain saw that is a work apparatus according to an embodiment of the invention. The chain saw of FIG. 1 is shown as not yet having attached a saw chain as a cutting element and with its upper cover removed to expose its engine and other components. FIG. 2 shows a basic configuration of the chain saw.

With reference to FIGS. 1 and 2, the chain saw 1 has a two-stroke single-cylinder engine 2. The engine 2 has an intake system comprising an air cleaner 4 at its upstream end and a carburetor 5 interposed between the air cleaner 4 and the engine 2. The engine 2 has an output shaft to which a centrifugal clutch 6 is connected. When engine revolution reaches and exceeds a predetermined reference revolution, power of the engine 2 is transmitted to a saw chain 7 via the centrifugal clutch 6.

The centrifugal clutch 6 is designed to get in engagement when the revolution of the engine 2 reaches 5,000 rpm. When the centrifugal clutch 6 gets in engagement, the engine 2 and the saw chain 7 are mechanically coupled. Normal revolution of the engine 2 is about 8,000 to 13,000 rpm.

The chain saw 1 includes a brake 8. The brake 8 is connected to a brake lever 9 that can be operated by an operator. By operating the brake lever 9, the operator can activate the brake 8 and thereby hold the saw chain 7 unrotational. The brake 8 and the brake lever 9 on board of the chain saw 1 are explained in detail in Patent Laid-open Publication No. JP 2001-47403. Disclosure of this publication is entirely incorporated herein.

The carburetor 5 has a throttle valve 10 and a choke valve 11. The throttle valve 10 is coupled to a throttle control trigger 12 operable by an operator. By operating the throttle control trigger 12 and thereby opening or closing the throttle valve 10, the operator can control the output of the engine 2. The choke valve 11 is coupled to a choke knob 13 operable by the operator. By operating the choke knob 13 for activating the engine 2, the operator can set the choke valve 11 at its full-shut position. Like conventional machines, the choke valve 11 and the throttle valve 10 are linked in operation by a link mechanism. Therefore, when the operator operates the coke knob 13, it not only sets the choke valve 11 at the full-shut position but also sets the throttle valve 10 at the first idling position.

Figure 3:
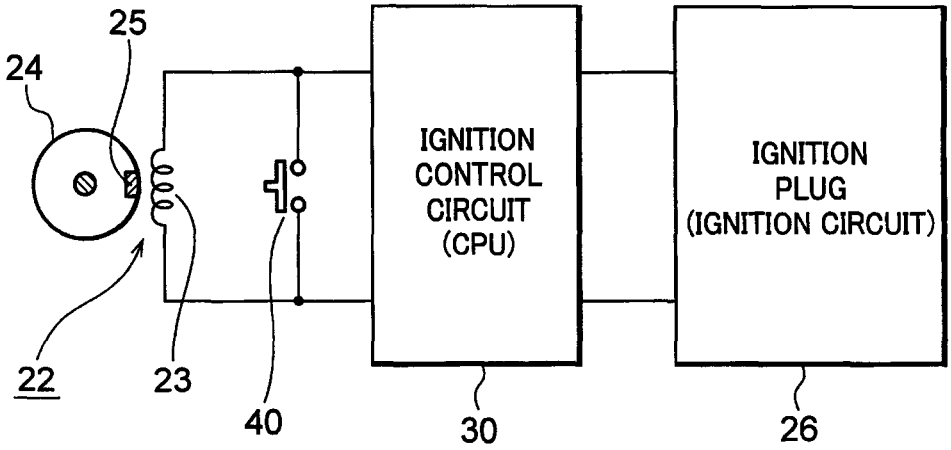
FIG. 3 is a system diagram of elements related to ignition control.

The engine 2 has a manual recoil starter 20. Operators can activate the engine 2 by lugging a starter grip 21. The engine 2 has an electric generating mechanism 22 as well. As shown in FIG. 3, the electric generating mechanism 22 comprises a combination of a generating coil 23 and a rotor 24. The rotor 24 has a magnet pole 25 thereon. The rotor 24 is driven by an engine output, and when rotated. When the rotor 24 rotates, the generating coil 23 receives a magnetic flux from the magnetic pole 25, and induces a pulse voltage. Level of the pulse voltage and timing for applying the voltage are responsive to rotating speed of the rotor 24 equated with the rotation speed of the engine 2. Of course, an ignition device 26 is ignited using the voltage generated by the electric generating mechanism 22.

Referring back to FIG. 2, control of the ignition device 26, more specifically, ON/OFF control of power supply to the ignition device 26 and control of the ignition timing are executed by a control means 30 comprising a microcomputer. The control means 30 has a function substantially of a CDI-type ignition control. The control means 30 is supplied with an ignition timing signal from the electric generating mechanism 22 (rotor 24), engine revolution signal (Ne) from a revolution sensor 31, an opening position signal indicative of an opened degree of the throttle valve 10 from a throttle position sensor 32, signal from a trigger operation sensor 33 for detecting whether or not the throttle control trigger 12 is operated, braking operation signal indicative of operation of the brake lever 9 from the braking operation sensor 34, temperature signal indicative of temperature of the centrifugal clutch 6 or its peripheral portion from a temperature sensor 35, and so on. The trigger operation sensor 33 may be either a sensor configured to detect only that the throttle control trigger 12 is in a released position or of a sensor detecting configured to detect how the throttle control trigger 12 has been operated.

The revolution sensor 31 may be a detector that directly detects revolution of a crankshaft (not shown) or a detector that detects revolution of the rotor 24 of the electric generating mechanism 22 (the rotor 24 is used for the revolution sensor 31). As shown in FIG. 2 with a broken line, the engine revolution may be detected indirectly by the clutch revolution sensor 36 that detects the revolution of the input shaft of the centrifugal clutch 6. Therefore, the engine revolution sensor intended in the present invention pertains to any of elements that detect rotation of the rotor 24 or detecting rotation of the input shaft of the centrifugal clutch 6 in addition to those that detect rotation of the crankshaft. That is, the engine revolution sensor intended in the present invention should be construed as any of devices or elements that detect revolution of a power transmission path including the input shaft of the centrifugal clutch 6, which is related to the engine 2, or others that detect revolution of any rotating elements of auxiliary devices related to the engine 2.

Reference numeral 40 in FIGS. 2 and 3 denotes an engine stop switch. By operating the engine stop switch 40, the operator can interrupt the power supply to the ignition device 26 and thereby stop the engine 2.

Procedures for activating the engine 2 in a cold state are identical to conventional ones as explained below.

(1) With reference to FIG. 1, in association with a front-side handle 45 extending across the main body of the chain saw, a brake lever 9 is provided at a forward adjacent position. This type of brake lever 9 is called a "hand guard" as well. The brake lever 9 takes a braking position inclined forward and a brake-releasing position moved rearward to get closer to the forward handle 45. When the engine should be activated, the brake lever 9 is set at the braking position beforehand (to fasten the brake 8).

(2) The choke knob 13 (FIG. 1) is pulled out. Thereby, the choke valve 11 is set at the full-shut position, and the throttle valve 10 is set at the "first idling position" responsively.

(3) Subsequently, the starter grip 21 of the recoil starter 20 is pulled several times to feed the cylinder of the engine 2 with fuel-rich air-fuel mixture. The action of pulling the starter grip 21 is continued until explosion takes place in the cylinder. At this stage, the engine 2 stops usually after several cycles of explosion because the fuel is too rich.

(4) After that, the choke knob 13 is pushed back. As a result, although the choke valve 11 returns to the full-open position, the throttle valve 10 is maintained at the "first idling position". In this status, if the action of pulling the starter grip 21 is resumed, then the engine 2 rotates continuously.

(5) When the user grips a rear handle 42 (FIG. 1) and presses down a throttle trigger lockout 43 (FIG. 1) projecting upward from the rear handle 42, the throttle control trigger 12 (not appearing in the view of FIG. 1) attached at the rear handle 42 is unlocked. When the operator subsequently squeezes throttle control trigger 12 by force, he/she can interrupt the linkage between the throttle valve 10 and the choke valve 11. In addition, when the user releases the throttle control trigger 12, the throttle valve 10 is set at the "normal idling position" that is a nearly full-shut position. Therefore, operation of the throttle control trigger 12 after activation of the engine can be regarded as an operation for interrupting the linkage between the throttle valve 10 and the choke valve 11.

(6) Before starting a work with the chain saw, the operator should turn the brake lever 9 (FIG. 1) rearward toward the main body and thereby set the front handle 45 at the brake-releasing position closer to the front handle 45 to release the brake 8. Then, the operator may squeeze the throttle control trigger 12 and starts a work with the chain saw.

Figure 4:
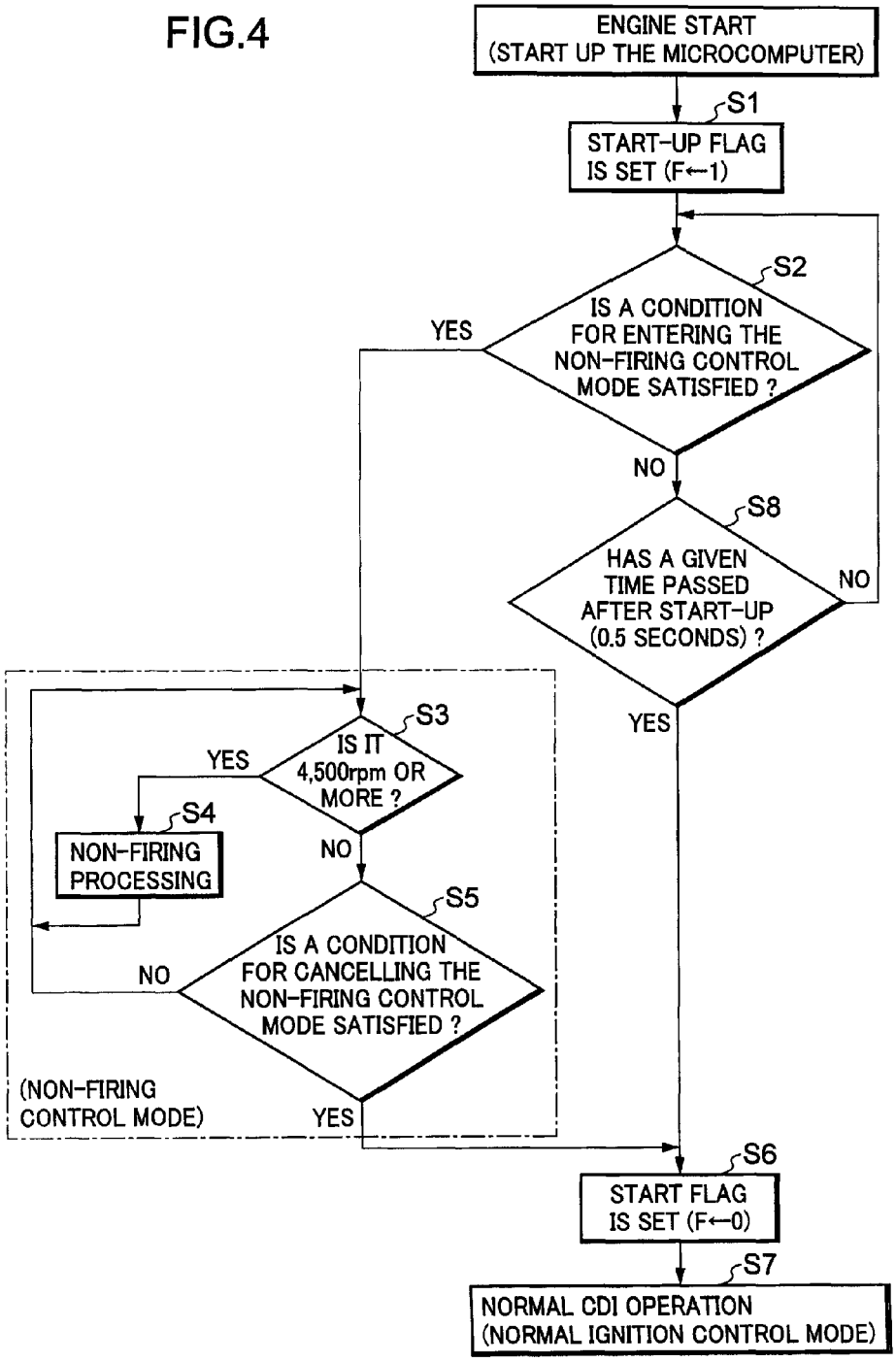
FIG. 4 is a flowchart for explaining the ignition control immediately after activation of the engine.

FIG. 4 is a flowchart for explaining a control according to the first embodiment. This flowchart has been prepared, assuming the microcomputer as the control means 30 is activated with power supplied from the electric generating mechanism 22 that is designed to start generation of electricity simultaneously with activation of the engine. The engine 2 is subjected to ignition control carried out in a normal ignition control mode, explained later, as from its initial running phase, and the non-firing processing is carried out when the revolution of the engine 2 increases higher than the predetermined reference revolution after activation.

For example, in case the engine 2 is activated when the throttle valve 10 is held in the first idling position, the non-firing control does not take place because the engine revolution is still low in the initial running phase. Therefore, the start reliability of the engine is assured under the valve opening degree (first idling position) in which the throttle valve 10 is opened considerably wide.

On the other hand, when the engine 2 enter in the transitional phase in which the engine 2 begins a stable run and its revolution rapidly increases, the non-firing processing is carried out. Therefore, the upper limit of the engine revolution is restricted by the non-firing processing. Accordingly, by setting the upper limit value at a revolution lower than the clutch-engaging revolution at which the friction elements of the centrifugal clutch 6 begin to engage, the centrifugal clutch 6 is prevented from unexpected, undesirable engagement in the transitional phase immediately after the initial running phase of the engine.

With reference to the flowchart of FIG. 4, an exemplary ignition control in the engine start period is explained. As already explained, the microcomputer used as the control means is activated by activation of the engine. The centrifugal clutch 6 used in this embodiment is designed to begin engagement of its friction elements at 5,000 rpm. Further, the first idling position of the throttle valve 10 is set a throttle opening degree enabling the engine revolution of 7,000 rpm approximately. In addition, the normal idling position is set at a throttle opening degree capable of maintaining the average engine revolution of about 2,700 rpm.

Initially in step S1, a start flag F is set (F=1). In next step S2, it is inquired and determined whether a given condition for entering the non-firing control mode is established or not. This step S2 is a procedure for estimating the transitional phase upon activation of the engine, explained above. From this standpoint, step S2 can be equated with a procedure for estimating whether the engine revolution becomes higher than the clutch-engaging revolution at which the centrifugal clutch begins to engage. As already explained, the engine revolution rapidly increases in the "transitional phase in the start period of the engine". Therefore, it is expected that, if the engine revolution is allowed to increase even after rising to 4,000 rpm or more, it will reach the clutch-engaging revolution (5,000 rpm). As a modification, a threshold for judging the level of acceleration of the engine revolution may be preset to execute the judgment of step S2. The acceleration may be calculated by dividing a difference between two consecutive detected revolutions by time, or may be obtained indirectly from the level of the difference between two consecutive detected engine revolutions.

If the non-firing control is used for safety upon inadvertent failure to activate the brake lever 9 ON, it may be added as an additional condition for entering the non-firing control mode that the braking operation signal from the braking operation sensor is OFF (the brake is not set at the braking position).

In case the revolution sensor 31 is attached to the crankshaft (not shown) or the rotor 24 of the electric generating mechanism 22 to detect the engine revolution (Ne), if the revolution (Ne) is sampled in extremely short time intervals, it is recommended to use an average value in a predetermined period of time to execute the judgment of step S2. If the revolution (Ne) is sampled at relatively long time intervals, it results in substantially detecting an average speed of the crankshaft or rotor 24 in the long duration of time. Therefore, the revolution (Ne) acquired by the revolution sensor 31 may be used for the judgment of step S2. This is applicable to the engine revolution (Ne) explained later as well.

Once a given condition for entering the non-firing control mode is satisfied (for example, the engine revolution is 4,000 rpm or more), with the answer of "YES", the non-firing control mode is set up.

The non-firing control mode is explained. It is first determined whether or not the engine revolution (Ne) is 4,500 rpm or more (step S3). As explained above, the clutch-engaging revolution for the centrifugal clutch 6 is set at 5,000 rpm. Therefore, the revolution 4,500 rpm that is the threshold used in step S3 is lower than the clutch-engaging revolution for the centrifugal clutch 6 by approximately 10%.

When the judgment in step S3 is YES (the engine revolution is 4,500 rpm or more), the flow proceeds to step S4 to carry out the non-firing processing. The non-firing processing herein pertains to a processing for interrupting the power supply to the ignition device 26 and thereby prevents combustion in the cylinder. As a modification, the ignition timing normally set at approximately 30° before the top dead center of the piston stroke may be extremely delayed, for example, to the bottom dead center so as to substantially prevent explosion of the air-fuel mixture in the cylinder. To distinguish from retardation control carried out in ordinary ignition control, the latter control by such a large retardation is herein called a "non-firing retardation". The non-firing retardation means a retardation that can substantially prevent explosion of air-fuel mixture in the cylinder.

The non-firing processing (step S4) is executed under the condition that the engine revolution (Ne) is 4,500 rpm or more as explained above. Since the revolution of 4,500 rpm is lower than 5,000 rpm (clutch-engaging revolution) at which friction elements of the centrifugal clutch 6 begin to engage, the upper limit of the engine revolution (Ne) can be kept lower than the clutch-engaging revolution for the centrifugal clutch 6 by the non-firing processing.

The non-firing processing in step S4 is continued until a canceling condition for canceling the non-firing control mode is satisfied (step S5). After the non-firing processing is executed several consecutive times, the control may be changed to an ordinary retardation processing. For example, even after the non-firing processing is repeated five consecutive times, for example, if it fails to suppress the engine revolution below 4,500 rpm, the engine output may be lowered by employing the maximum retardation level among retardation control values used in ordinary engine control.

Exemplary canceling conditions for canceling the non-firing control mode may be that (1) the trigger operation sensor 33 for detecting operation of the throttle control trigger 12 detects that the trigger 12 has been operated by the user; (2) the engine revolution (Ne) of 4,000 rpm or less continues for a certain duration of time; (3) occurrences of the non-firing processing (S4) decreases to below a predetermined value; (4) occurrences of the "NO" answer of step S3 (decision that the revolution is lower than 4,500 rpm) exceeds a certain value; (5) the braking operation signal from the brake operation sensor 34 changes from ON to OFF (the brake lever 9 has been released); and so forth.

If the non-firing control mode lasts for a time longer than a predetermined time, or the occurrences of the non-firing processing exceed a predetermined value, the aforementioned non-firing processing, i.e. interruption of power supply to the ignition device 26 or non-firing retardation, may be replaced by retardation control based on, for example, the maximum retardation among retardation controls executed in normal ignition timing control (normal ignition control mode). This is applicable to the control variation of FIGS. 12 and 13 as well.

When one or more of the above-mentioned canceling conditions for canceling the non-firing control mode is established, the flow proceeds from step S5 to step S6, and the non-firing control mode is canceled after resetting the start flag (F=0). Thereafter, ignition by the ignition device 26 takes place in accordance with the normal ignition control mode that executes normal ignition actions (CDI, TCI, etc.). In the course of transition from the non-firing control mode to the normal ignition control mode, or during execution of the non-firing control mode, an advance processing that will explained later with reference to FIG. 12 may be executed (S61 of FIG. 13).

In step S2 already explained, if it determines that a given condition for entering in the non-firing control mode is not yet satisfied, the flow proceeds to step S8. If the condition for entering the non-firing control mode is not yet established even after a predetermined time (for example, 0.5 seconds) from initial activation, the flow proceeds to step S6. Then, the start flag is reset (F=0) in step S6, and the non-firing control mode is canceled (step S7). In the engine start period, the time required from the initial running phase to the transitional phase, then to stabilized phase, is usually 0.5 seconds or less. If the condition is not established even after 0.5 seconds from initial activation of the engine, the judgment may decide that throttle valve 10 is in the normal idling position, and it is expected that no situation requiring the non-firing control mode (S4) will occur.

Figure 5:
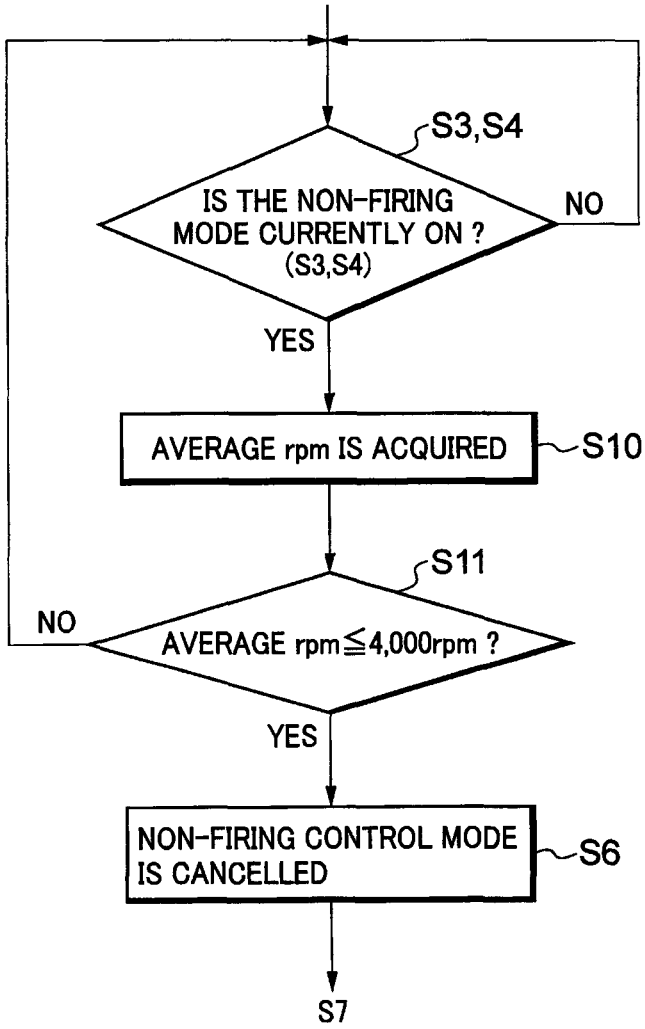
FIG. 5 is a flowchart for explaining a modification that cancels a non-firing control mode executed in the ignition control immediately after activation of the engine.
Figure 6:
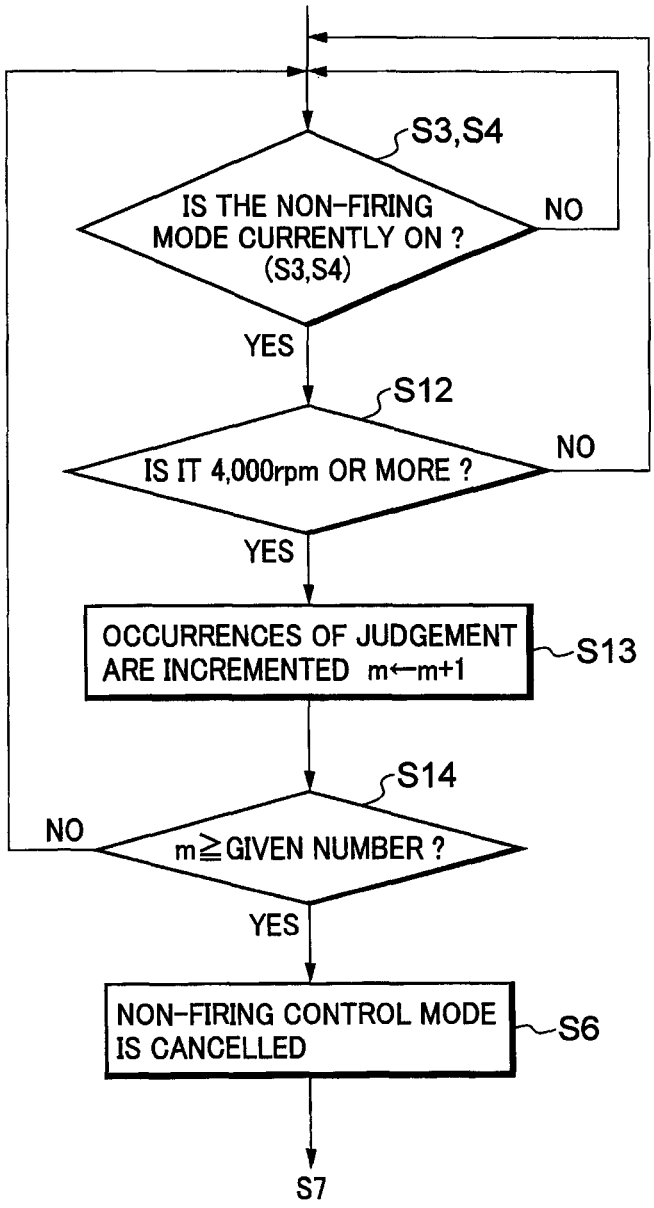
FIG. 6 is a flowchart for explaining another modification for canceling the non-firing control mode executed in the ignition control immediately after activation of the engine.
Figure 7:
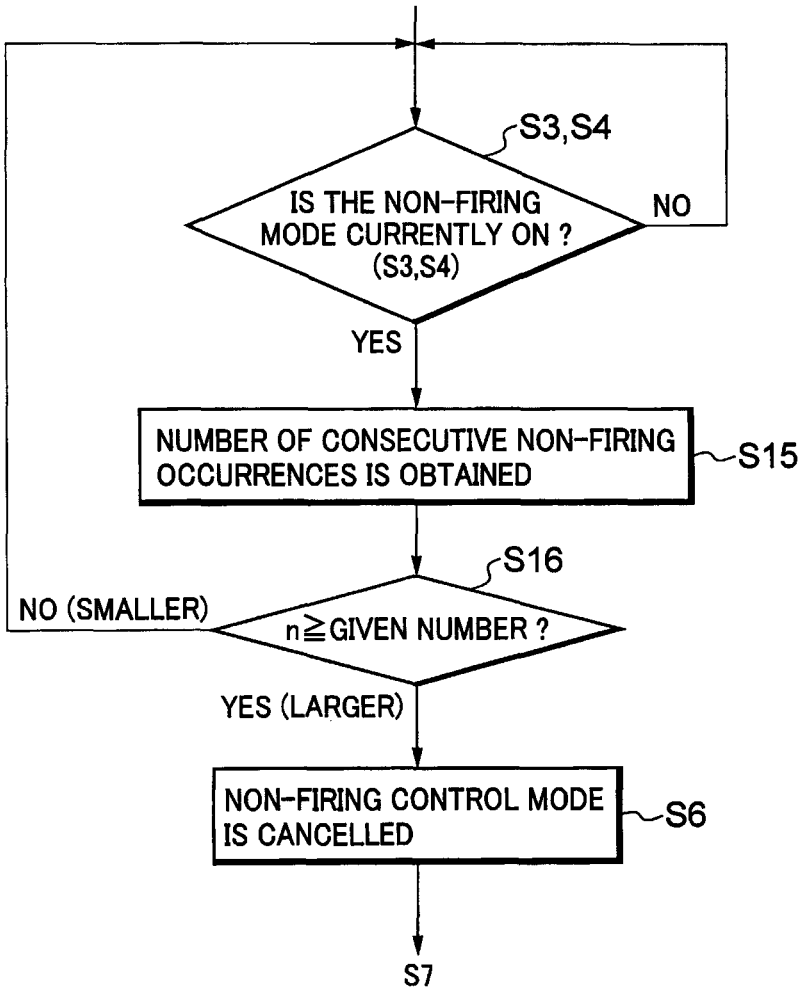
FIG. 7 is a flowchart for explaining still another modification for canceling the non-firing control mode executed in the ignition control immediately after activation of the engine.

FIGS. 5 through 7 are flowcharts for explaining modified procedures for canceling the non-firing control mode upon canceling the non-firing control mode and entering into the normal ignition control mode for executing normal ignition (S7 of FIG. 4).

With reference to FIG. 5, during execution of those steps S3 and S4 (FIG. 4), an average revolution in a predetermined duration of time is calculated (S10); the average engine revolution obtained undergoes judgment whether it is equal or under a threshold value (for example, 4,000 rpm) (S11); and if it enters in the range not higher than 4,000 rpm (YES in S11), it is decided that the throttle valve 10 has moved from the first idling position to the normal idling position and the non-firing control mode is canceled (S6).

With reference to FIG. 6, during execution of the steps S3 and S4 (FIG. 4), when the engine revolution has become equal to or lower than the threshold (for example, 4,000 rpm), the flow proceeds from step S12 to step S13, and the number of occurrences (m) of judgment in step S12 is incremented. In next step S14, the number of judgment occurrences m exceeds a predetermined threshold, the judgment determines that the throttle valve 10 has moved from the first idling position to the normal idling position, and the non-firing control mode is canceled (S6).

Figure 8:
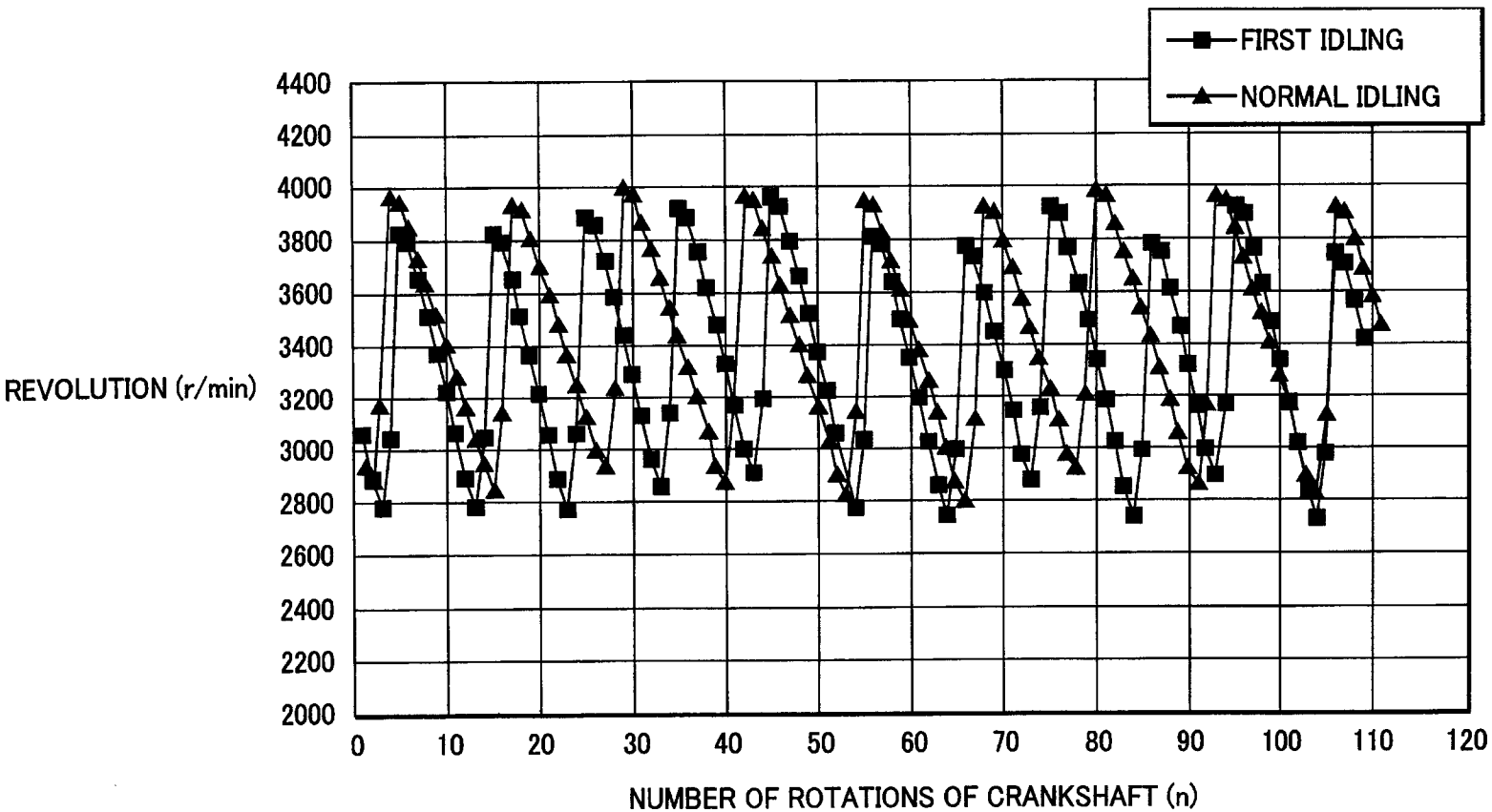
FIG. 8 is a diagram showing data of changes of the engine revolution and non-firing processing obtained by actual measurement as a basis of the non-firing control mode of FIG. 7, which is in form of waveforms of revolution variance corresponding to a first idling position and a normal idling position of a throttle valve.

Like FIGS. 5 and 6, the flowchart of FIG. 7 relates to the judgment of whether the non-firing control mode should be canceled or not. FIG. 7, however, shows an example of control for enabling a user to work with the work apparatus by canceling the non-firing control mode when the idling revolution (engine revolution) is especially high at the normal idling position. Before explaining the example of FIG. 7, FIG. 8 is referred to, which shows changes in engine revolutions during execution of the non-firing processing (step S4 of FIG. 4) in the non-firing control mode when the throttle valve 10 is in the first idling position and during execution of the non-firing processing (step S4 of FIG. 4) in the non-firing control mode when the throttle valve 10 is in the normal idling position. In FIG. 8, the abscissa shows the number of rotations (n) of the crankshaft; square dots show the points where igniting action is executed at the first idling position; and triangular dots indicate the points where igniting action is executed at the normal idling position.

In the midcourse where the engine revolution decreases, the non-firing processing is being executed. In the normal idling position (triangular dots), eleven consecutive occurrences of non-firing processing are observed, for example, in the leftmost waveform showing a decelerating process. On the other hand, in the first idling position (square dots), eight consecutive occurrences of non-firing processing are observed in the same left-most waveform showing the decelerating process.

From another viewpoint of the waveforms of FIG. 8, each unit cycle since the engine revolution increases until it decreases is different between the first idling position and the normal idling position. The normal idling position takes a longer time for completing one cycle than in the first idling position.

As explained with reference to FIG. 8, in case the first idling position and the normal idling position are different in non-firing processing characteristics, a difference in number of consecutive occurrences of non-filing processing or a difference in engine revolution may be used to discriminate whether the throttle valve 10 is in the first idling position or in the normal idling position.

With reference to FIG. 7, in the midcourse of execution of steps S3 and S4 (FIG. 3) (FIG. 4), the number of consecutive occurrences of non-firing processing is calculated (S15). If the obtained number of consecutive occurrences of non-firing processing reaches or exceeds a predetermined value used as a threshold (when the answer is "YES") (S16), the throttle valve 10 is regarded as being at the normal idling position, and the non-firing control mode is canceled (S6).

On the other hand, if the number of consecutive occurrences of non-firing process is decided to be smaller than the predetermined threshold value in step S16 (when the answer is "NO"), then the throttle valve 10 is regarded to be at the first idling position, and the non-firing control mode is maintained.

The control of FIG. 7 may be modified such that the changing cycle of the engine revolution is obtained; if the cycle is longer as compared with a threshold value, the throttle valve 10 is regarded to be in the normal idling position, and the non-firing control mode is cancelled.

FIG. 4 was explained above as showing ignition control upon activation of the engine. In contrast, FIGS. 9 through 13 show an ignition timing control after completion of the ignition control of FIG. 4 carried out upon activation of the engine.

Figure 9:
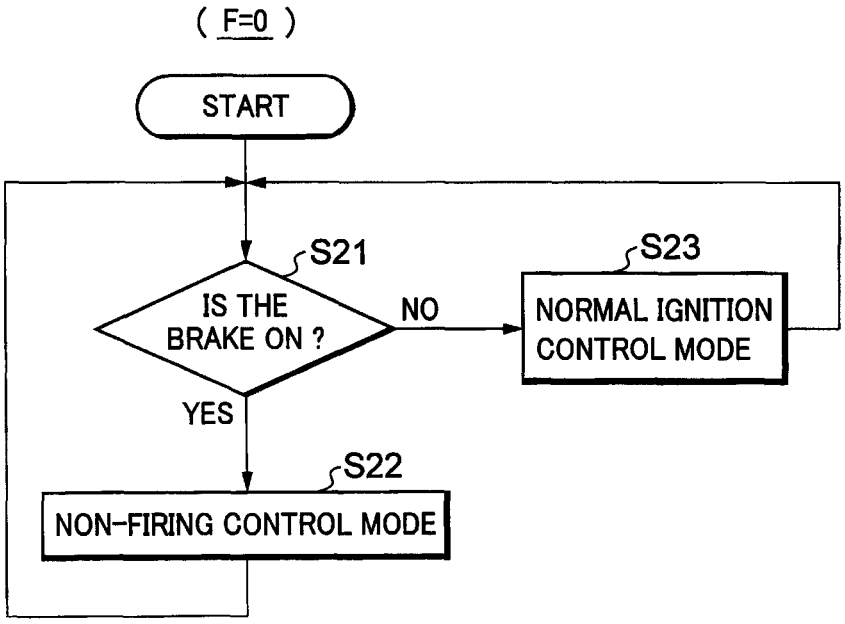
FIG. 9 is a flowchart for explaining an ignition control related to braking.

FIG. 9 is a flowchart for explaining procedures for executing non-firing process when the engine revolution rises due to some sort of reason even though the brake 8 is in the braking position. With reference to FIG. 9, it is judged whether the brake 8 is in the braking position or not in step S21. This judgment is based on a signal from a brake operation sensor 34 that detects that the brake lever 9 is in the ON state (braking position). As an alternative, a sensor for detecting that a friction element of the brake 8 is in a fastened state may be used for judgment of step S21.

If the answer of step S21 is "YES", i.e. when the brake lever 9 is at the ON position (braking position) and the brake 8 may be regarded to be in the braking state, then the flow proceeds to step S22 and the non-firing control mode is set up. This non-firing control mode is substantially the same as that already explained with reference to FIG. 4, and non-firing processing is carried out when the engine revolution reaches 4,500 rpm or higher. Therefore, as long as the brake lever 9 is held in the ON position, the non-firing control can restrain the engine revolution (Ne) within a range capable of maintaining the centrifugal clutch 6 in a released state. As a result, the friction elements of the centrifugal clutch 6 are protected from wear by friction.

If the answer of S21 is "NO", since the brake lever 9 is in the OFF position, the normal ignition control mode is set up, and ignition is executed by the normal ignition procedure (S23). Therefore, once the user operates the throttle control trigger 12, the engine 2 outputs a power responsive to the operated amount of the throttle control trigger 12. Of course, since the brake 8 is in the released state, once the engine revolution (Ne) exceeds 5,000 rpm, the centrifugal clutch 6 gets in engagement and the power of the engine 2 is transmitted to the saw chain 7.

The control of FIG. 9 is explained in association with the ignition control (ignition control upon activation of the engine (FIG. 4)). The control of FIG. 9, however, may be executed alone apart from the ignition control upon activation (FIG. 4). This is applicable to controls of FIGS. 10 and 11, explained below, as well.

Figure 10:
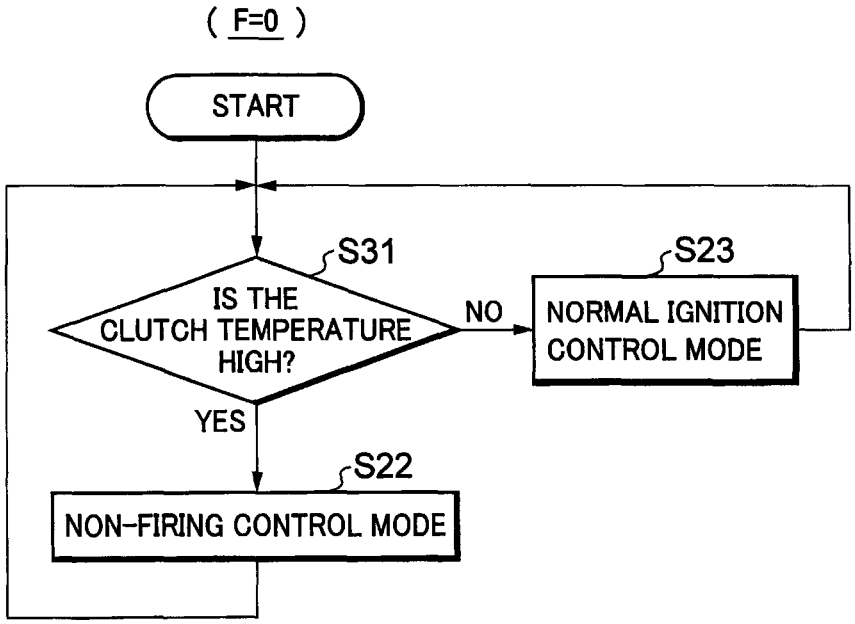
FIG. 10 is a flowchart for explaining a modification of the control of FIG. 9.

FIG. 10 shows a modification of the control of FIG. 9. The control of FIG. 9 is configured to detect that the brake lever 9 has been set ON. In the control of FIG. 10, however, temperature of the centrifugal clutch 6 or its surroundings is detected. Then, if the temperature of friction elements of the centrifugal clutch 6 becomes higher than a predetermined level, one reason or another is presumed to exist. Namely, the centrifugal clutch 6 might be slipping because of its wear by friction, or the centrifugal clutch 6 is moved by force in s slipping mode because the engine revolution (Ne) accidentally rises because of some sort of reason even though the brake 8 is in the braking position. Accordingly, non-firing processing is carried out (S22). A threshold to decide that the non-firing processing should be executed or not is set at an engine revolution near to and higher than 5,000 rpm at which the friction elements of the centrifugal clutch 6 begin to engage.

As a modification regarding selection of the threshold, a revolution slightly lower than 5,000 rpm, such as 4,800 rpm, may be selected. Such a slightly lower threshold value is suitable in an application in which the centrifugal clutch 6 is desirably prevented from tendency to engage even for a very short time upon a momentary rise of the engine revolution. In this manner, it is possible to more reliably prevent wear by friction of the friction elements of the centrifugal clutch 6 and an undesirable increase of temperature of the centrifugal clutch or its peripheries.

If the non-firing processing is executed frequently in the control of FIG. 10, it is recommended to give a notice to the user by using an alarm means such as an alarm light which provides continuous light or flickering noticeable for the user.

Figure 11:
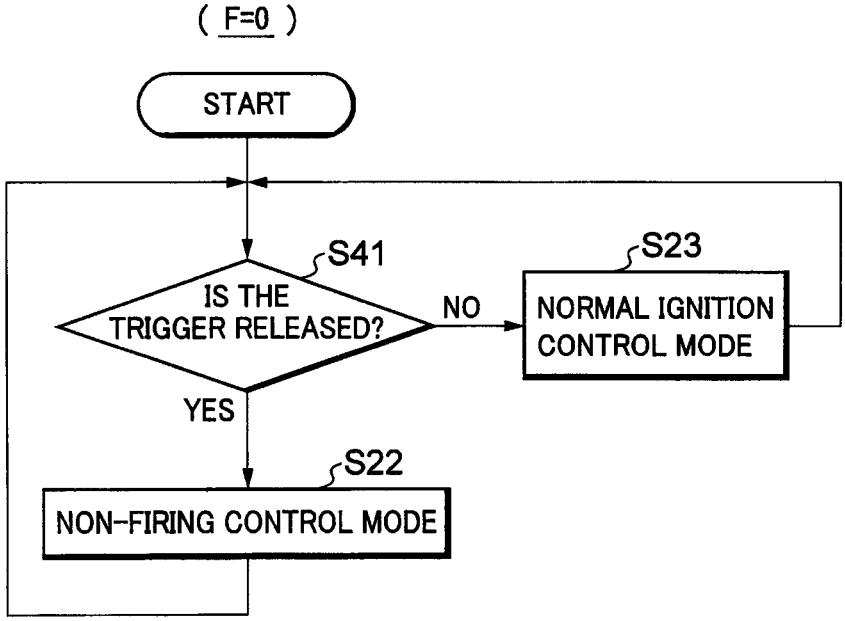
FIG. 11 is a flowchart for explaining an ignition control related to operation of a throttle control trigger.

FIG. 11 shows a control for preventing the saw chain 7 from accidentally running due to a rise of the engine revolution for some sort of reason notwithstanding the user does not touch the throttle control trigger 12. With reference to the flowchart of FIG. 11, in response to a signal from the trigger operation sensor 33 for detecting operation of the throttle control trigger 12, it is judged whether the throttle control trigger 12 is in the released state or not (S41). If the answer is "YES", which means that the throttle control trigger 12 is in the released state, the non-firing control mode is set up.

This non-firing control mode 22 is carried out when the engine revolution (Ne) reaches 4,500 rpm or higher. Therefore, the centrifugal clutch 6 is prevented from getting into engagement due to an increase of the engine revolution (Ne). As a result, it is prevented that the saw chain 7 accidentally starts running notwithstanding the user does not even touch the throttle control trigger 12.

If the answer of step S41 is "NO", which means that the throttle control trigger 12 has been operated by the user, the normal ignition control mode is set up (S23), and the air-fuel mixture is ignited by the normal ignition procedure. Therefore, the engine outputs a power responsive to the amount of operation of the throttle control trigger 12.

Figure 12:
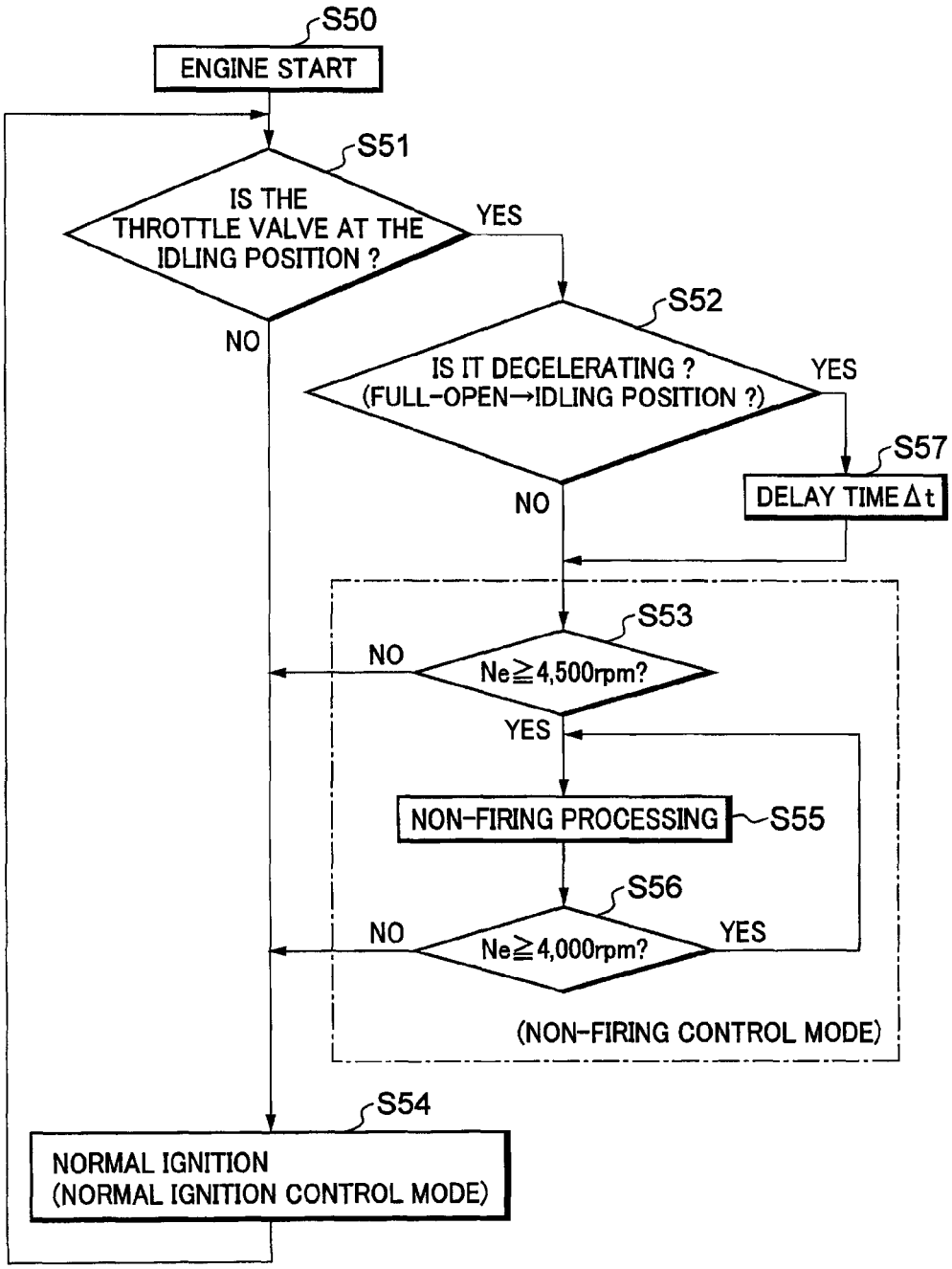
FIG. 12 is a flowchart for explaining an ignition control executed not only upon activation of the engine but also thereafter.

FIG. 12 is a flowchart for explaining a control for enhancing the safety throughout a series of procedures from activation of the engine to an intended work for cutting something with the work machine.

Once an operation for activating the engine is commenced (S50), it is first judged in step S51 whether the throttle valve 10 is in the idling position or not. For judgment of the idling position of the throttle valve 10, a signal from the throttle position sensor 32 is used. This may be modified to detect that the throttle control trigger 12 is in the released position and determine that the throttle valve 10 is in the idling position when the throttle control trigger 12 has been detected to be in the released state. The idling position, referred to here, involves both the "normal idling position" and the "first idling position" explained before. In general, activation of the engine is carried out while the throttle valve 10 is held in the first idling position. Therefore, in the stage soon after the flow has proceeded from the above-explained step S50, judgment in step S51 is carried out to determine whether the throttle valve 10 is held in the first idling position or not, and with an answer of "YES", the flow proceeds to step S52.

In step S52, whether the engine is being decelerated or not is judged. Since the engine is not currently under deceleration, the answer of the judgment is "NO, and the flow proceeds to the next step S53 to determine whether the engine revolution (Ne) has risen to 4,500 rpm or higher. When the flow proceeds to step S53 for the first time, the engine is still in the initial running phase. Therefore, it is considered that the engine revolution (Ne) is usually lower than 4,500 rpm. Accordingly, with the answer of "NO", the flow proceeds to step S54 and executes ignition by the normal ignition procedure.

As this flow is continued, the running mode of the engine enters into the transitional phase and the engine revolution rapidly increases to 4,500 rpm. Then, the judgment of step S53 gives the answer of "YES", and non-firing processing is carried out in step S55. If the engine revolution does not decrease below 4,000 rpm even after the non-firing processing, the flow returns from step S56 back to step S55 to execute non-firing processing again. When this processing decreases the engine revolution to a value lower than 4,000 rpm, the flow moves from step S56 to step S54, and ignition is carried out by the normal ignition procedure.

When the user operates the throttle control trigger to begin a work with the work machine, in case the work machine is a chain saw that is used for a work normally with its trigger 12 squeezed to the utmost, ignition is executed by the normal ignition procedure of step S54, and engine power responsive to the operated amount of the trigger 12 is outputted.

When the user releases the throttle control trigger 12 after a certain unit of work, the throttle valve 10 takes the normal idling position. In this state, the flow moves from step S51 to step S52, judgment takes place to determine whether the engine is decelerating (S52). For this judgment of deceleration, a change in opening degree of the throttle valve 10 may be judged, referring to a signal from the throttle position sensor 32, or a trigger operation signal associated with the throttle control trigger 12. Of course, for judgment of deceleration, a change of the engine revolution may be used as a reference.

Since the engine is currently being decelerated, the answer of step S52 for judgment of deceleration is "YES", and the flow proceeds to step S57. In this step S57, after a delay time ($\Delta t$) for waiting that the engine revolution (Ne) decreases, the flow proceeds to step S53. In step S53, it is judged whether the engine revolution (Ne) is equal to or higher than 4,500 rpm as explained above. Normally, the engine revolution (Ne) decreases to, for example, 2,700 rpm corresponding to the opening degree of the throttle valve 10 at the normal idling position. Therefore, with an answer of "NO", the flow proceeds to step S54, and ignition is carried out by the normal ignition procedure. Accordingly, the average revolution of 2,700 rpm, which is the normal idling revolution, is maintained.

If the engine revolution does not decrease as much as expected due to some kind of reason even after the delay time ($\Delta t$), and the answer of step S53 is "YES", which means that the engine speed has been determined to be 4,500 rpm or higher, then the flow proceeds to step S55 to execute non-firing processing. This non-firing processing is carried out every time when the engine revolution (Ne) is determined to be 4,500 rpm or higher. Therefore, if the engine revolution tends to increase to 4,500 rpm or higher for some sort of cause even though the throttle valve 10 is in the normal idling position, the centrifugal clutch 6 is held disengaged by the non-firing processing (S55) to halt the rotation of the saw chain 7.

Figure 13:
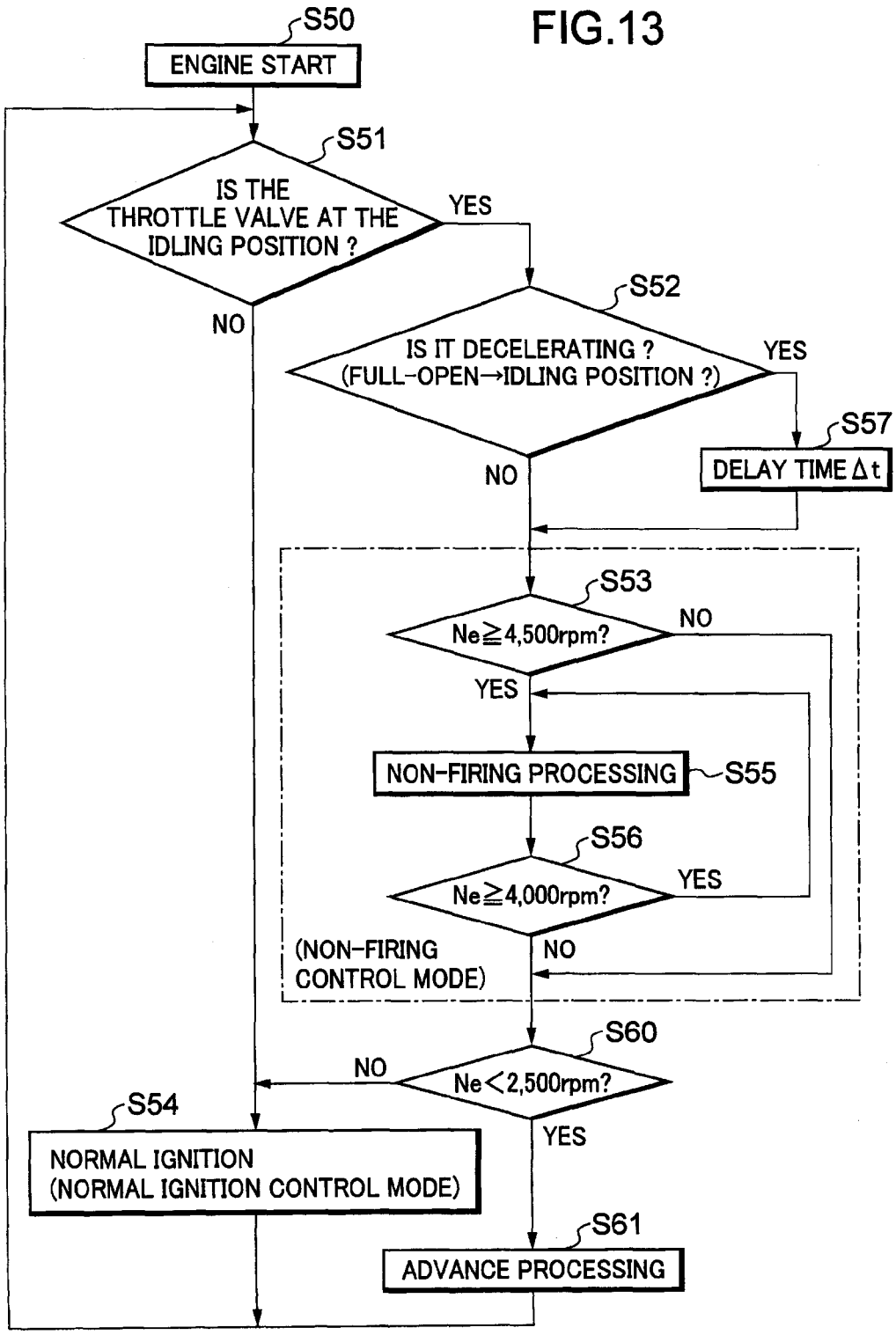
FIG. 13 is a flowchart for explaining a modification of the control of FIG. 12.

FIG. 13 is a modification of the control of FIG. 12. Therefore, its explanation is omitted by labeling common steps with step numbers identical to those of FIG. 12. The control of this modification includes an additional step S60 after the non-firing processing. In this step S60, it is judged whether the engine revolution (Ne) is the normal idling revolution or slightly lower than it. That is, step S60 judges whether the engine is likely to stop because of excessive decrease of the engine revolution by the non-firing processing (S55). When its answer is "YES", which indicates that the engine revolution (Ne) has been decreased excessively, the flow proceeds to step S61. In this step S61, a control toward restoring the running condition of the engine by advancing the ignition timing.

In the control of S61, by adding the advance processing along the way of transition from the non-firing control to the normal ignition control, the possibility of engine stop due to excessive decrease of the engine revolution by the non-firing processing can be reduced. The advance processing may be added to the ignition control upon activation of the engine of FIG. 4 as well.

In case a predetermined operation of the user is used as a canceling condition for canceling the non-firing control mode of step S5 (FIG. 4) explained above, judgment of step S5 may be executed depending upon presence of absence of a signal from a switching mechanism that is responsive to the users predetermined operation and detects it. There are the following examples usable as the switching mechanism.

(1) A switch may be provided as a trigger operation sensor 33 for detecting operation of the throttle control trigger 12.

(2) A switch may be provided as a brake operation sensor 34 for detecting that the brake lever 9 has been released.

(3) A switch may be provided, which detects that the user has gripped the front handle 42 and/or the rear handle 45 (FIG. 1).

(4) A switch may be provided, which detects that the throttle trigger lockout 43 for unlocking the throttle control trigger 12 has been operated.

(5) A manual switch may be provided, which switches the non-firing control mode and the normal ignition control mode alternately.

As suggested by the above examples, the users action of gripping the front and rear handles 42, 45, for example, may be regarded as an intentional action for starting a work with the work machine. Therefore, the above-mentioned user's operations may be deemed to have a high possibility of transition to a running condition for which the non-firing control mode is obstructive. Alternatively, from another aspect, the above-mentioned user's operations may be regarded to currently pay attention to movements of the saw chain. Therefore, the non-firing control mode (FIGS. 4, 12 and 13) may be canceled when any of those user's actions or operations is detected.

Practically, any configurations may be designed for the above-listed switches. For example, known switch sensors such as pressure-sensitive switch sensors, magnetic switch sensors, optical switch sensors, ultrasonic switch sensors, etc. may be employed.

Figure 14:
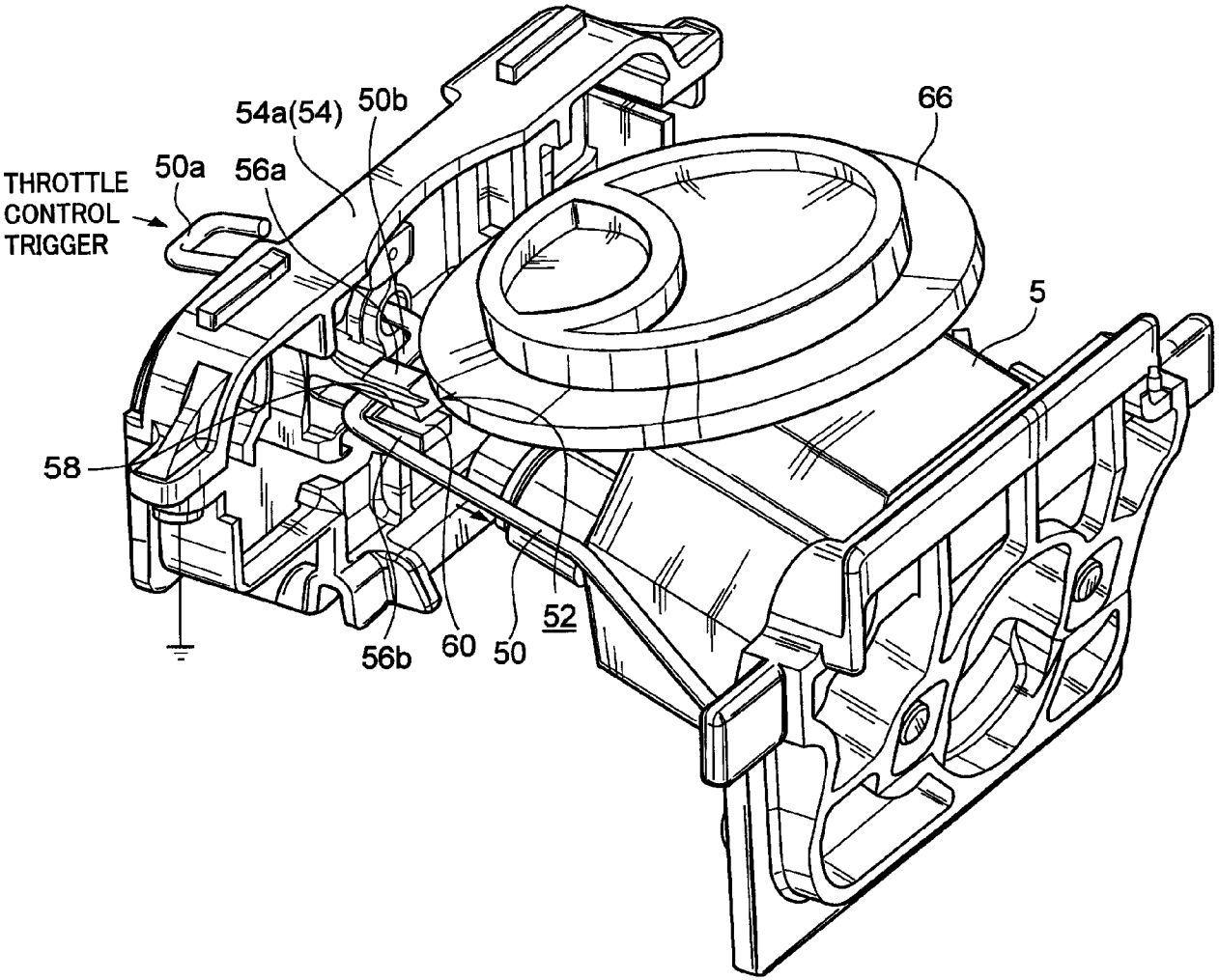
FIG. 14 is diagram showing a specific example of a throttle operation detecting switch located in association with a throttle operation rod that makes linkage between the throttle control trigger and the throttle valve.
Figure 15:
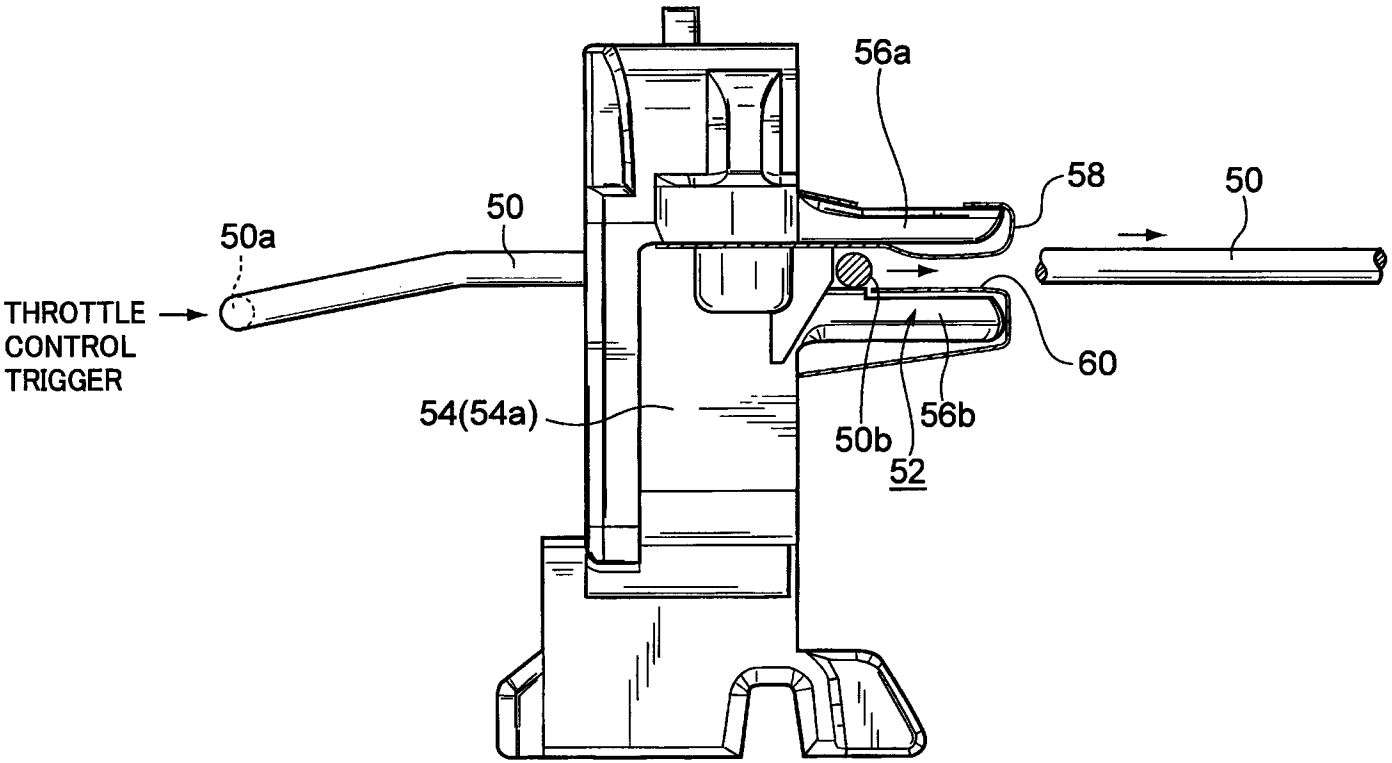
FIG. 15 is a diagram related to FIG. 14, which shows a status of the throttle operation detecting switch taken when the throttle control trigger is in a released position.
Figure 16:
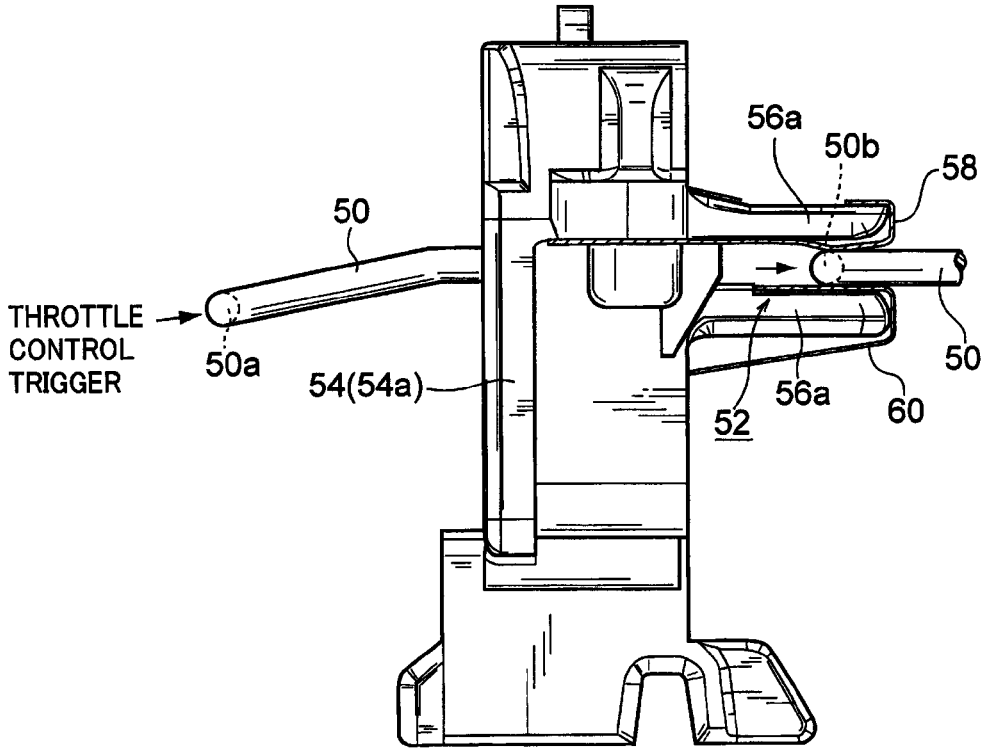
FIG. 16 is a diagram related to FIG. 14, which shows a status of the throttle operation detecting switch taken when the throttle control trigger is in a squeezed position.

FIGS. 14 through 16 show a switching mechanism 52 associated with a throttle operation rod 50 that makes linkage between the throttle control trigger 12 and the throttle valve 10. This switching mechanism 52 is equivalent to the trigger operation sensor 33 explained above.

The throttle operation rod 50 extends through a rear end wall 54*a* of a main body outer case 54 surrounding the engine 2, air cleaner 4 and others, at a portion from which the rear-side handle 42 extends outwardly (FIG. 1). The rear end portion of the throttle operation rod 50 extends into the rear-side handle 42. The throttle operation rod 50 is connected at its rear end to the throttle valve 10. On the other hand, its rear end 50*b* bent in form of the letter L is engaged with the throttle control trigger 12. When the user squeezes the throttle control trigger 12, the throttle operation rod 50 is brought forward by a movement of the throttle control trigger 12, and the throttle valve 10 is opened by the forward movement of the throttle operation rod (engine output is increased).

The throttle operation rod 50 has a configuration bent in shape of a crank inside the main body outer case 54 made of an insulating plastic material and covered by an upper cover (FIG. 14). This crank-shaped portion 50*b*, i.e. the portion extending to intersect approximately perpendicularly with the moving direction of the throttle operation rod 50, is held between a pair of upper and lower elongated projections 56*a*, 56*b* extending forward from the read end wall 54*a*.

The upper elongated projection 56*a* and the lower elongated projection 56*b* are provided with separate metal leaves 58, 60 attached on opposed surfaces of their front end portions. These metal leaves 58, 60 constitute a part of the switching mechanism 52 explained above.

With reference to FIG. 15, the upper metal leaf 58 has a bent shape to have flexibility like a spring. Although the lower metal leaf 60 is shaped flat, it may have a bent shape like the upper metal leaf 58.

The upper and lower metal leaves 58, 60 may be made of any material provided it is electrically conductive. In this embodiment, both the upper and lower metal leaves 58, 60 are made of a stainless steel thin plate. The upper metal leaf 58 is connected to the control means 30 whereas the lower metal leaf 60 is connected to a ground potential. Reference numeral 66 in FIG. 14 denotes a base plate for an air cleaner to sit on.

FIG. 15 shows a status in which the throttle control trigger is in a released state and the throttle operation rod 50 is at the rear-most position of the back-and-forth moving stroke. In this state, the crank-shaped portion 50*b* of the throttle operation rod 50 is in a position apart rearward from the upper and lower metal leaves 58, 60.

FIG. 16 shows a status in which the throttle control trigger 12 is in a position tightly squeezed by a user, and the throttle operation rod 50 has been moved forward from the rearmost position of the back-and-forth moving stroke. In this state, the crank-shaped portion 50*b* of the throttle operation rod 50 is clipped by the upper and lower metal leaves 58, 60, and the upper metal leaf 58 is urged upward by the crank-shaped portion 50*b*. Thus, the upper and lower metal leaves 58, 60 are electrically connected.

It will be understood from comparison of FIGS. 15 and 16 that the upper and lower metal leaves 58, 60 and the crank-shaped portion 50*b* constitute the switching mechanism 52. In this switching mechanism 52, the crank-shaped portion 50*b* extending across the moving direction of its own, which is the back-and-forth direction, acts as a traveling contact, and the upper and lower metal leaves 58, 60 act as a fixed contact. In the switching mechanism 52, when the user squeezes the throttle control trigger 12, an ON signal from the switching mechanism 52 is inputted to the control means 30. This operation of the user onto the trigger 12 can be regarded as an intentional operation that no more requires the non-firing processing. That is, the operation may be equated with a demonstration of a user's request for canceling the non-firing control mode. Therefore, in receipt of the ON signal from the switching mechanism 52, the flow proceeds from step S5 to step S6 in FIG. 4, and cancels the non-firing control mode after resetting the start flag (F=0). Thereafter, ignition by the ignition device 26 is carried out (S7) at the timing according to the normal ignition control mode for normal ignition procedure (CDI, TCI, or the like) (S7).

The switching mechanism 52 explained with reference to FIGS. 14 through 16 is located inside the main body outer case 54 that is covered by an upper cover, and it is composed of the crank-shaped portion 50*b* movable along with back-and-forth movement of the throttle operation rod 50 and the metal leaves 58, 60 for frictional contact with the crank-shaped portion 50*b*. Therefore, the switching mechanism 52 can be reduced in occurrences of malfunctions caused by adhesion of dust. In addition, since the metal leaves 58, 60 can be accessed to by simply removing the upper cover, maintenance of the switching mechanism 52 is easy.

Figure 17:
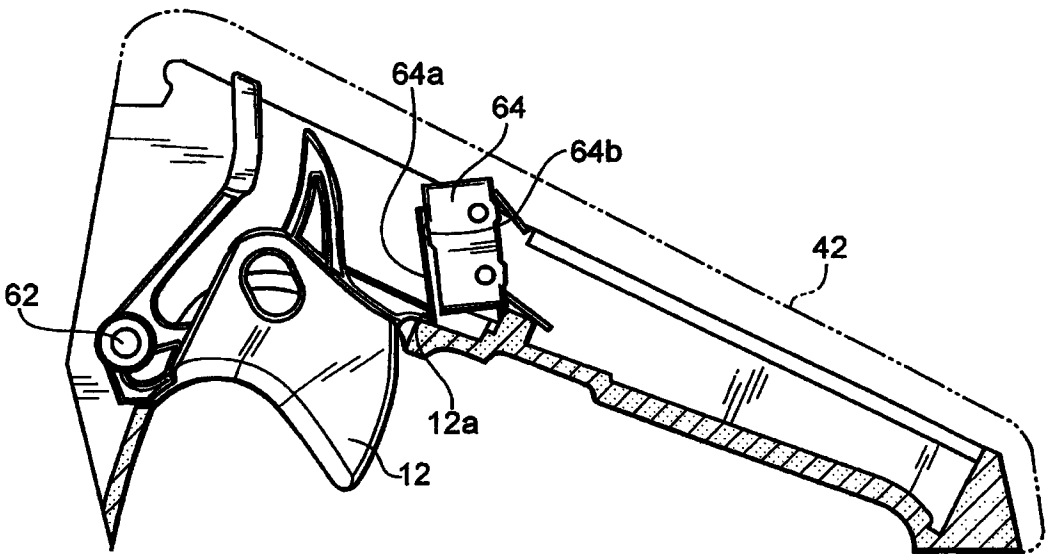
FIG. 17 is a diagram showing an example in which a micro switch is provided adjacent to the throttle control trigger to act as the throttle operation detecting switch, in which the throttle control trigger is in the released position.
Figure 18:
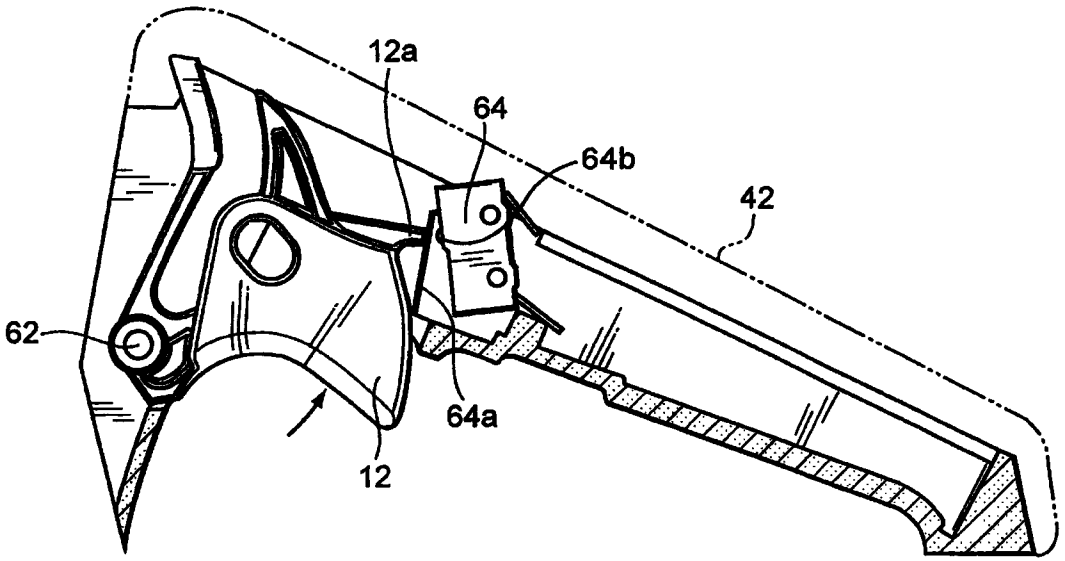
FIG. 18 is a diagram related to FIG. 17, in which the throttle control trigger is in the squeezed position.

A modification of the switching mechanism for detecting operation of the throttle control trigger 12 is explained with reference to FIGS. 17 and 18. In FIGS. 17 and 18, reference numeral 62 denotes a rotation center axis of the throttle control trigger 12. A micro switch 64 is provided behind the throttle control trigger 12. The throttle control trigger 12 has a projection 12*a* formed to project toward the micro switch 64.

FIG. 17 shows the throttle control trigger 12 in a released state. FIG. 18 shows the throttle control trigger 12 in a squeezed state. With reference to FIG. 17, in the released state of the throttle control trigger 12, the projection 12*a* integral with the trigger 12 urges a traveling contact 64*a* to bring it into contact with a fixed contact 64*b*.

With reference to FIG. 18, in this squeezed state of the throttle control trigger 12, the projection 12*a* is at a location moved upward location together with the throttle control trigger 12 and does not push the traveling contact 64*a*. Therefore, the traveling contact 64*a* is apart from the fixed contact 64*b*.

In the modification of FIGS. 17 and 18 using the micro switch 64, an OFF signal is supplied to the control means 30 from the micro switch 64 when a user tightly squeezes the throttle control trigger 12. This operation of the user onto the trigger 12 can be regarded as an intentional operation that no more requires the non-firing processing. That is, the operation is equated with a demonstration of a user's request for canceling the non-firing control mode. Therefore, in receipt of the ON signal from the micro switch 64, the flow proceeds from step S5 to step S6 in FIG. 4, and cancels the non-firing control mode after resetting the start flag (F=0).

Of course, the ON or OFF signal from the micro switch 64 can be outputted in the inverted form. Therefore, the micro switch 64 may be modified to output an ON signal when the user has squeezed the throttle control trigger 12 and output an OFF signal when the user has released the throttle control trigger 12. In this case, the ON signal from the micro switch 64 is regarded to indicate a user's intentional operation with the expectation of cancellation of the non-firing mode, and the non-firing mode is canceled accordingly.

Figure 19:
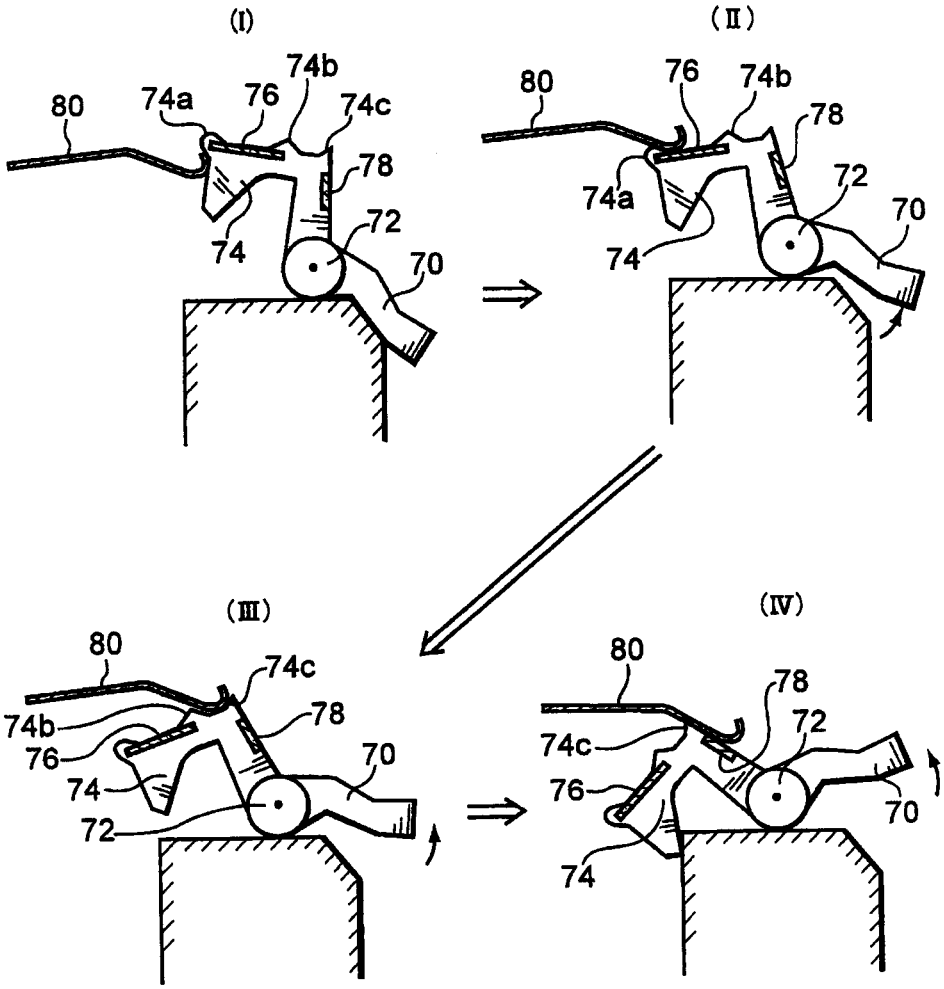
FIG. 19 is a diagram for explaining a switching mechanism for detecting a request for canceling the non-firing control mode in association with a manual selector. At the position of the selector shown at (I), the throttle valve is set at the "first idling position" and the choke valve is set at the "full-shut position". At the position of the selector shown at (II), the throttle valve is maintained at the "first idling position" and the choke valve is set at the "full-open position". At the position of the selector shown at (III), power supply to the ignition device is interrupted and the engine stops.

FIG. 19 shows an example in which a manually operated selector, already known in the art, is modified into a switching mechanism for detecting user's predetermined operations remarked in the present invention. With reference to FIG. 19, the selector 70 can swing about a rotation center axis 72, and can take four positions shown by sketches (I) through (IV) in FIG. 19 depending on the user's operation, like those of conventional designs.

When the selector 70 is held at the position in sketch (I), the throttle valve 10 is fixed at the "first idling position", and the choke valve 11 is fixed at the "full-shut position".

In sketch (II) of FIG. 19, the selector 70 is at a position slightly raised from the position of sketch (I). When the selector 70 is fixed at the position of sketch (II), the throttle valve 10 maintains the "first idling position", but the choke valve 11 moves from the "full-shut position" to the "full-open position".

In sketch (III) of FIG. 19, the selector 70 is at a position slightly raised from the position of sketch (II). When the selector 70 is fixed at the position of sketch (III), the throttle valve 10 changes from the "first idling position" to the "normal idling position". The choke valve 11 is still maintained at the "full-shut position".

In sketch (IV) of FIG. 19, the selector 70 is at a position further raised from the position of sketch (III). When the selector 70 is fixed at the position of sketch (IV), power supply to the ignition device 26 is interrupted, and the engine 2 stops consequently.

The selector 70 has an actuating element 74 in form of an L-shaped small plate when viewed in its side elevation, which swings integrally with the selector 70. The actuating element 74 is a mold of an insulating plastic material.

The actuating element 74 has first and second two fixed contacts 76, 78. The actuating element 74 is preferably molded to integrally include first to third three projections 74*a* through 74*c*. With this design, a feeling of click touch can be provided in motion of the spring-like contact terminal 80 from one position to another.

With reference to sketch (I) of FIG. 19, the distal end of the contact terminal 80 is in abutting contact with the distal end surface of the currently upright distal end surface of the actuating element 74. In the next sketch (II), along with rotation of the actuating element 74 in the clockwise direction in the drawing, the spring-like contact terminal 80 relatively moves, overleaping the first projection 74*a*, and gets in abutting contact with the first fixed contact 76. In the next sketch (III), along with further rotation of the actuating element 74 in the clockwise direction, the contact terminal 80 relatively moves, overleaping the second projection 74*b*, and takes a fixed position between the second projection 74*b* and the next third projection 74*c*. At this position, the contact terminal 80 is apart from the first fixed contact 76. In the next sketch (IV), along with further rotation of the actuating element 74 in the clockwise direction, the contact terminal 80 relatively moves, overleaping the third projection 74*c*, and gets into abutting contact with a proximal-side end surface of the actuating element 74 and into abutting contact with the second fixed contact 78 formed along provided on the proximal-side end surface.

In the state shown by sketch (IV) where the contact terminal 80 is in contact with the second fixed contact 78, power supply to the ignition device 26 is interrupted, and the engine 2 stops consequently. That is, the second fixed contact 78 acts as a part of the engine stop switch 40 already explained with reference to FIG. 2.

In the state where the spring-like contact terminal 80 is in abutment with the second fixed contact 78 (sketch IV), the throttle valve 10 is in the "first idling position", and the choke valve 11 is in the "full-open position", as explained above. When an ON signal generated by electrical conduction of the contact terminal 80 with the first fixed contact 65 is supplied to the control means 30, the control means 30 sets up the non-firing control mode (change from step S2 to step S3 in FIG. 4). Therefore, the non-firing control mode can be set up by positioning of the selector 70 at the position shown in sketch (II).

When the user next brings the selector 70 to the position shown by sketch (III) of FIG. 19, the user's operation onto the selector 70 can be equated with a user's request for canceling the non-firing control mode. Accordingly, the contact terminal 80 is set apart from the first fixed contact 76, and the electric circuit made of the contact terminal 80 and the first fixed contact 76 is interrupted. As a result, with an OFF signal supplied, the control means 30 cancels the non-firing control mode (proceeds from step S5 to step S6 in FIG. 4). Therefore, when the user operates the selector 70 to bring it to the position shown in sketch (III) of FIG. 19, this operation is equated with a user's request for canceling the non-firing control mode, and the non-firing control mode is canceled accordingly.

Heretofore, the present invention has been explained by way of the chain saw 1 taken as an embodiment of the invention. However, skilled persons in the art will understand that the present invention is applicable to various other portable work apparatuses or machines such as brush cutters, hedge trimmers, and so on.

INDUSTRIAL APPLICABILITY

The present invention is applicable with a great effect to engine control of normal idling run and first idling run just after engine start typically for work apparatuses or machines having a single-cylinder, compact-sized engine on board.

KEY TO REFERENCE SYMBOLS AND NUMERALS

1 Chain saw
2 Engine
5 Carburetor
6 Centrifugal clutch
7 Saw chain
8 Brake
9 Brake lever
10 Throttle valve
11 Choke valve
12 Throttle control trigger
13 Choke knob
20 Recoil starter
30 Control means (microcomputer)
31 Engine revolution sensor
32 Throttle position sensor
33 Trigger operation sensor
34 Braking sensor
35 Temperature sensor (for detecting temperature of centrifugal switch or its peripheries)
36 Sensor for detecting revolution of input shaft of centrifugal clutch
50 Electrically conductive throttle operation sensor
50*b* Crank-shaped portion of throttle operation rod
58 Upper metal leaf (one of fixed contacts)
60 Lower metal leaf (counterpart fixed contact)
70 Selector

The invention claimed is:

1. A work apparatus with an internal combustion engine of a portable type, including the internal combustion engine which has a carburetor having a throttle valve to generate power by igniting air-fuel mixture supplied from the carburetor with an ignition device; and a centrifugal clutch interposed between the internal combustion engine and a cutting element to transmit the power of the internal combustion engine to the cutting element via the centrifugal clutch when engaged, comprising:

an engine start detecting means for detecting that said internal combustion engine is in a start period;

a revolution detecting means for detecting revolution of the internal combustion engine; and an ignition control means responsive to a signal from the revolution detecting means in said start period of the engine to execute non-firing processing for said ignition device when said revolution of the internal combustion engine is higher than a first predetermined revolution, a throttle control trigger mechanically coupled to said throttle valve and operated by an operation force applied from a user; and a trigger operation detecting means for detecting that said throttle control trigger has been moved, wherein, in response to a signal sent from said trigger operation detecting means when said trigger operation detecting means detects that the throttle control trigger has been moved, said non-firing control mode is canceled and the normal ignition control mode is set up under the determination that said predetermined canceling condition has been satisfied, wherein said control means includes:

a non-firing control mode for executing said non-firing processing;

a normal ignition control mode not executing said non-firing processing; and an estimating means responsive to a signal from said revolution detecting means to estimate whether the engine revolution becomes higher than a clutch-engaging revolution at which said centrifugal clutch begins to engage, wherein said non-firing control mode is set up when said estimating means estimates that the engine revolution will increase higher than the clutch-engaging revolution, and the non-firing control mode is cancelled and said normal ignition control mode is set up when a predetermined canceling condition is satisfied and wherein a trigger operation detecting means includes a switching mechanism comprising:

an electrically conductive throttle operation rod connecting said throttle control trigger to said throttle valve and movable in response to an amount of operation of said throttle control trigger to control a degree of opening of said throttle valve responsively; and two metal leaves opposed to each other via a distance and brought into electrical conduction when getting into contact with said throttle operation rod, wherein said throttle operation rod is brought into a position sandwiched by said two metal leaves and makes said electrical conduction between said metal leaves when said throttle control trigger is moved, and wherein said throttle operation rod is apart from at least one of said metal leaves and thereby interrupts said electrical conduction between said metal leaves when said operation force to said throttle control trigger is removed.

2. The work apparatus according to claim 1 wherein, when the engine revolution reaches a second predetermined revolution near to and lower than the clutch-engaging revolution, the control means determines that the engine revolution will increase beyond the clutch-engaging revolution and sets up the non-firing control mode.

3. The work apparatus according to claim 1 wherein, when acceleration of the engine revolution increases beyond a predetermined acceleration, said control means determines that the engine revolution will increase beyond the clutch-engaging revolution, and sets up the non-firing control mode.

4. A work apparatus with an internal combustion engine of a portable type, including the internal combustion engine which has a carburetor having a throttle valve to generate power by igniting air-fuel mixture supplied from the carburetor with an ignition device; and a centrifugal clutch interposed between the internal combustion engine and a cutting element to transmit the power of the internal combustion engine to the cutting element via the centrifugal clutch when engaged, comprising:

an engine start detecting means for detecting that said internal combustion engine is in a start period;

a revolution detecting means for detecting revolution of the internal combustion engine; and an ignition control means responsive to a signal from the revolution detecting means in said start period of the engine to execute non-firing processing for said ignition device when said revolution of the internal combustion engine is higher than a first predetermined revolution, wherein said control means includes:

a non-firing control mode for executing said non-firing processing;

a normal ignition control mode not executing said non-firing processing; and an estimating means responsive to a signal from said revolution detecting means to estimate whether the engine revolution becomes higher than a clutch-engaging revolution at which said centrifugal clutch begins to engage, wherein said non-firing control mode is set up when said estimating means estimates that the engine revolution will increase higher than the clutch-engaging revolution, and the non-firing control mode is cancelled and said normal ignition control mode is set up when a predetermined canceling condition is satisfied and further comprising:

a choke valve associated with said carburetor;

a selector operated manually to switch said choke valve between a full-shut position and a full-open position, and a switching mechanism including a fixed contact fixed stationary on said selector and a contact terminal that can get into contact with said fixed contact, wherein said selector takes three positions that are first, second and third positions, wherein, in said first position of the selector, said choke valve is fixed at said full-shut position, and in response to the change of the choke valve to the full-shut position, said throttle valve is fixed at a first idling position, wherein, in said second position, said choke valve is maintained in the full-open position, but said throttle valve is fixed at a nearly full-shut position that is a normal idling position, wherein when the selector is fixed at the first position, said fixed contact and said contact terminal get in contact and make an electrical conductive state of said switching mechanism, whereas when the selector is fixed at the second position, said fixed contact and said contact terminal are apart from each other and thereby make an electrically non-conductive state of said switching mechanism, and wherein when the selector is at the first position and said switching mechanism is in the electrically conductive state, said non-firing control mode is set up, wherein when the selector is at the second position and said switching mechanism is in the electrically non-conductive state, said non-firing control mode is canceled and said normal ignition control mode is set up under the determination that said predetermined canceling condition has been satisfied.

5. The work apparatus according to claim 4 wherein the engine revolution continues to be lower than a third predetermined revolution that is lower than said first predetermined revolution for a predetermined duration of time, said non-firing control mode is canceled and said normal ignition control mode is set up under the determination that said predetermined canceling condition has been satisfied.

6. The work apparatus according to claim 4 wherein, when the engine revolution becomes lower than a fourth predetermined revolution that is lower than said first predetermined revolution in a midcourse of execution of said non-firing control mode, ad advance processing is executed for the ignition timing.

7. A work apparatus with an internal combustion engine of a portable type, including the internal combustion engine which has a carburetor having a throttle valve to generate power by igniting air-fuel mixture supplied from the carburetor with an ignition device; a manual throttle control trigger for controlling the open-close motion of said throttle valve; and a centrifugal clutch interposed between the internal combustion engine and a cutting element to transmit the power of the internal combustion engine to the cutting element via the centrifugal clutch engaged when the engine output is increased by operation of said throttle control trigger, comprising:

an engine revolution detecting means for detecting engine revolution of said internal combustion engine;

an idling position detecting means for detecting whether said throttle valve is in an idling position or not; and an ignition control means for executing non-firing processing for said ignition device when the throttle valve is in said idling position and said engine revolution is higher than a first predetermined revolution wherein a trigger operation detecting means includes a switching mechanism comprising:

an electrically conductive throttle operation rod connecting said throttle control trigger to said throttle valve and movable in response to an amount of operation of said throttle control trigger to control a degree of opening of said throttle valve responsively; and two metal leaves opposed to each other via a distance and brought into electrical conduction when getting into contact with said throttle operation rod, wherein said throttle operation rod is brought into a position sandwiched by said two metal leaves and makes said electrical conduction between said metal leaves when said throttle control trigger is moved, and wherein said throttle operation rod is apart from at least one of said metal leaves and thereby interrupts said electrical conduction between said metal leaves when said operation force to said throttle control trigger is removed.

8. The work apparatus according to claim 7 wherein said ignition control means executes an advance processing when the engine revolution becomes lower than a second predetermined revolution that is lower than said first predetermined revolution after execution of said non-firing processing.

9. The work apparatus according to claim 7 further comprising a deceleration determining means for determining a decelerating state where the revolution of the internal combustion engine decreases, wherein, under the condition where the throttle valve is at the idling position, when the engine revolution is higher than said first predetermined revolution after a predetermine time later than said deceleration determining means detects said decelerating state of the internal combustion engine, said ignition control means executes the non-firing processing for the ignition device.

10. The work apparatus according to claim 9 wherein, when the engine revolution becomes lower than a predetermined second revolution lower than said first predetermined revolution after execution of the non-firing processing, said ignition control means executes an advance processing.

* * * * *

UNITED STATES PATENT AND TRADEMARK OFFICE

CERTIFICATE OF CORRECTION

PATENT NO. : 8,469,001 B2
APPLICATION NO. : 12/622874
DATED : June 25, 2013
INVENTOR(S) : Takuo Yoshizaki et al.

It is certified that error appears in the above-identified patent and that said Letters Patent is hereby corrected as shown below:

In the Claims:

Col. 23, line 55:

"ad" should read "an"

Signed and Sealed this
Tenth Day of September, 2013

Teresa Stanek Rea
*Acting Director of the United States Patent and Trademark Office*